US009314404B2

(12) United States Patent
Gonzalez-Miranda et al.

(10) Patent No.: US 9,314,404 B2
(45) Date of Patent: Apr. 19, 2016

(54) DRUG COMPOUNDING SKID AND COMPOUNDING METHOD

(71) Applicant: Allergan, Inc., Irvine, CA (US)

(72) Inventors: Jose Gonzalez-Miranda, Waco, TX (US); Brad Borgwald, McGregor, TX (US); Thomas Buckley, Hewitt, TX (US); Barry Hart, Monticello, MN (US)

(73) Assignee: Allergan, Inc., Irvine, CA (US)

( * ) Notice: Subject to any disclaimer, the term of this patent is extended or adjusted under 35 U.S.C. 154(b) by 426 days.

(21) Appl. No.: 13/848,586

(22) Filed: Mar. 21, 2013

(65) Prior Publication Data

US 2014/0209727 A1 Jul. 31, 2014

Related U.S. Application Data

(63) Continuation-in-part of application No. 13/756,461, filed on Jan. 31, 2013, now abandoned.

(51) Int. Cl.

| | |
|---|---|
| ***B02C 17/00*** | (2006.01) |
| ***A61J 3/00*** | (2006.01) |
| ***B02C 19/00*** | (2006.01) |
| ***B01F 13/10*** | (2006.01) |

(52) U.S. Cl.

CPC ..... *A61J 3/002* (2013.01); *B01F 13/1022* (2013.01); *B01F 13/1055* (2013.01); *B02C 17/00* (2013.01); *B02C 19/0056* (2013.01); *Y10T 137/0402* (2015.04); *Y10T 137/4266* (2015.04)

(58) Field of Classification Search

CPC ..... A61J 3/00; A61J 3/002; B01F 13/1022; B01F 13/1055; Y10T 137/0402; Y10T 137/4266; B02C 19/00; B02C 19/0056; B02C 17/00

USPC ..... 241/153, 2

See application file for complete search history.

(56) References Cited

U.S. PATENT DOCUMENTS

| | | | | |
|---|---|---|---|---|
| 3,310,245 A * | 3/1967 | Decker | B02C 17/14 | 241/153 |
| 3,785,675 A * | 1/1974 | Norris | B60P 3/32 | 280/768 |
| 7,783,383 B2 * | 8/2010 | Eliuk | A61J 1/20 | 141/1 |

* cited by examiner

*Primary Examiner* — Mark Rosenbaum

(74) *Attorney, Agent, or Firm* — Joel B. German

(57) ABSTRACT

A drug compounding skid for sterile transfer of a compounded drug. The skid includes vessels configured to form a sterile seal of a drug contained therein. The skid may include a sterilization system, a drug transfer system, and a cleaning system. The skid may be used to perform sterile transfer of a compounded drug from the vessels to a holding tank. A skid may include a plurality of drug compounding tanks with agitation devices mounted thereto.

12 Claims, 27 Drawing Sheets

| FIG. 1A | FIG. 1B |
|---|---|

| FIG. 10A | FIG. 10B | FIG. 10C |
|---|---|---|

DRUG COMPOUNDING SKID AND COMPOUNDING METHOD

CROSS-REFERENCE

This application is a continuation-in-part of U.S. patent application Ser. No. 13/756,461, filed Jan. 31, 2013, the entire contents of which is incorporated here by reference.

FIELD OF THE INVENTION

The present disclosure relates to drug compounding skids and methods.

BACKGROUND OF INVENTION

Methods and apparatuses for producing compounded drugs typically involve aseptic environments which require numerous precautions to assure the drugs produced remain sterile for human use. Often, such methods include an individual compounding a drug upon a mill within a compounding vessel. The individual then physically reaches into the compounding vessel to scoop out the drugs that have been compounded therein. The individual places the received drugs in a storage container for further processing or delivery for packaging.

The individual must be certain to not contaminate the compounded drugs with any aseptic materials, such as bacteria or other undesired microbes.

In addition, the individual must labor to physically remove the drugs, and then clean the compounding vessel as desired.

There is therefore a need to provide for ease of sterile transfer of compounded drugs.

There is also a need for further ease of automation of compounding products.

SUMMARY OF THE INVENTION

Aspects of the present specification disclose a skid apparatus for sterile transfer of a compounded drug.

In one embodiment, the present specification discloses a frame configured to stand upon a supporting surface. A vessel has an interior chamber and an outer surface with a first open end and a second open end, and configured to retain a drug that is compounded within the interior chamber, and having a first valve at the first open end and a second valve at the second open end that are configured to form a sterile seal of the drug compounded within the interior chamber. The vessel is configured to be releasably retained by the frame and to be used with a drug compounding device that compounds the drug within the interior chamber when the vessel is released from the frame.

A sterilization system is coupled to the frame and is configured to direct sterilizing steam to contact and sterilize the first valve and the second valve when the vessel is retained by the frame.

A drug transfer system is coupled to the frame and is configured to direct fluid such that the fluid passes through the first valve, then through the interior chamber, and then through the second valve to transfer the drug that is compounded within the interior chamber to a holding tank when the vessel is retained by the frame.

In one embodiment, the present specification discloses a method for sterile transfer of a sterile compounded drug. The method includes providing a vessel having an interior chamber and an outer surface with a first open end and a second open end, and having a first valve at the first open end and a second valve at the second open end, the vessel retaining the sterile compounded drug in the interior chamber, the first valve and the second valve both being closed and forming a sterile seal of the sterile compounded drug within the interior chamber. The method includes securing the vessel to a skid frame. The method includes operating a sterilization system coupled to the skid frame to direct sterilizing steam to contact and sterilize the first valve and the second valve when the first valve and the second valve are closed. The method includes operating a drug transfer system coupled to the skid frame to direct fluid through the first valve when the first valve is open, then through the interior chamber, and then through the second valve when the second valve is open, to transfer the sterile compounded drug from the interior chamber to a holding tank.

In one embodiment, the present specification discloses a skid apparatus for use to compound drugs. The skid apparatus includes a frame configured to stand upon a supporting surface.

A first drug compounding tank is coupled to the frame and configured to retain a drug for compounding within the first drug compounding tank.

A first agitation device is coupled to the first drug compounding tank and configured to agitate the drug retained within the first drug compounding tank when the drug retained within the first drug compounding tank is being compounded.

A second drug compounding tank is coupled to the frame and is configured to retain a drug for compounding within the second drug compounding tank.

A second agitation device is coupled to the second drug compounding tank and is configured to agitate the drug retained within the second drug compounding tank when the drug retained within the second drug compounding tank is being compounded.

A first conduit is configured to allow the drug retained within the first drug compounding tank to transfer to the second drug compounding tank.

A second conduit is configured to allow the drug retained within the second drug compounding tank to transfer to a holding tank.

BRIEF DESCRIPTION OF THE DRAWINGS

Features and advantages of the present invention will become appreciated as the same become better understood with reference to the specification, claims, and appended drawings wherein:

DETAILED DESCRIPTION OF THE PREFERRED EMBODIMENTS

Figures 1, 1A:
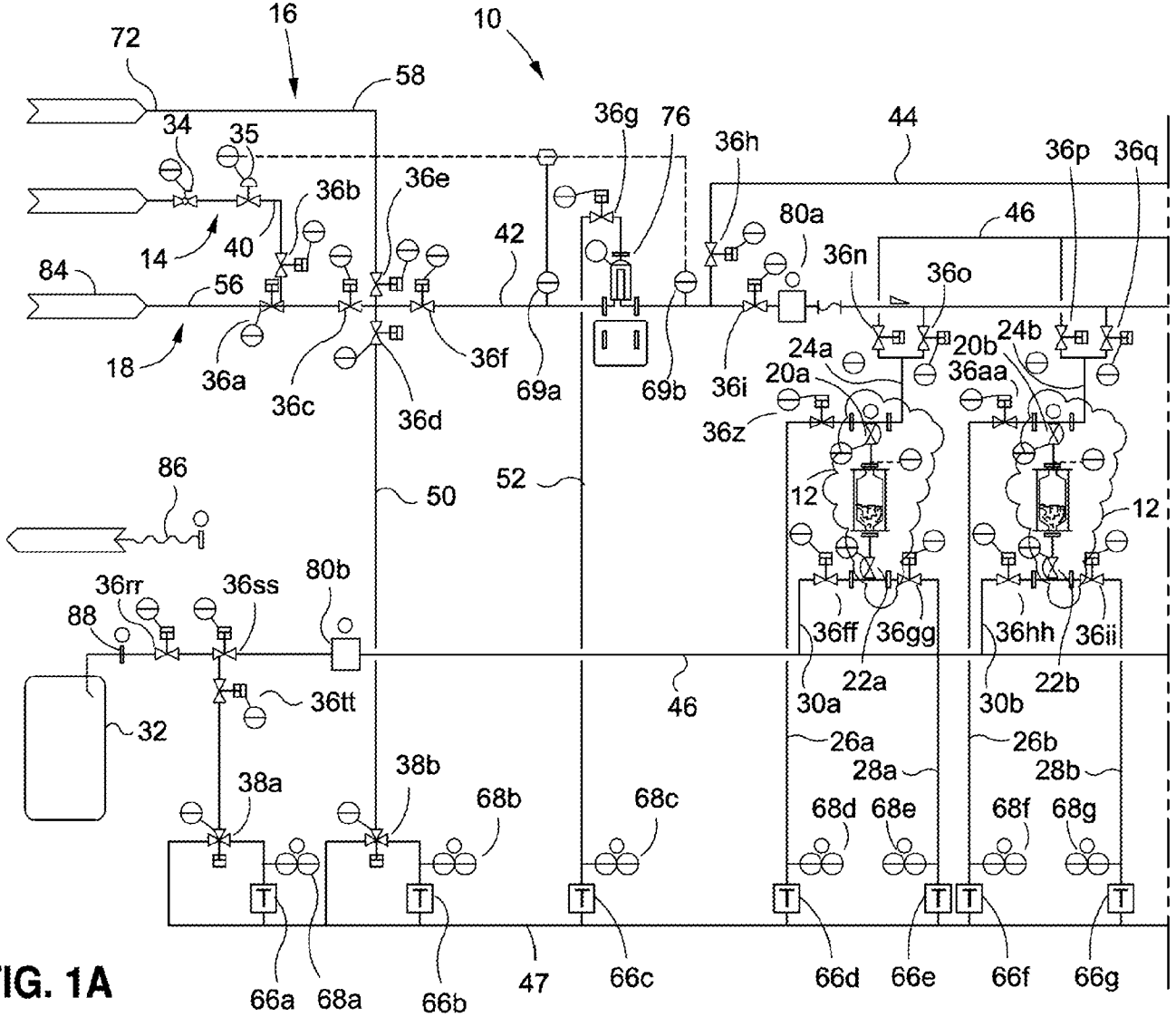
FIG. 1 is a schematic view of a drug compounding skid according to an embodiment of the present invention, divided into parts FIG. 1A and FIG. 1B.
Figure 1B:
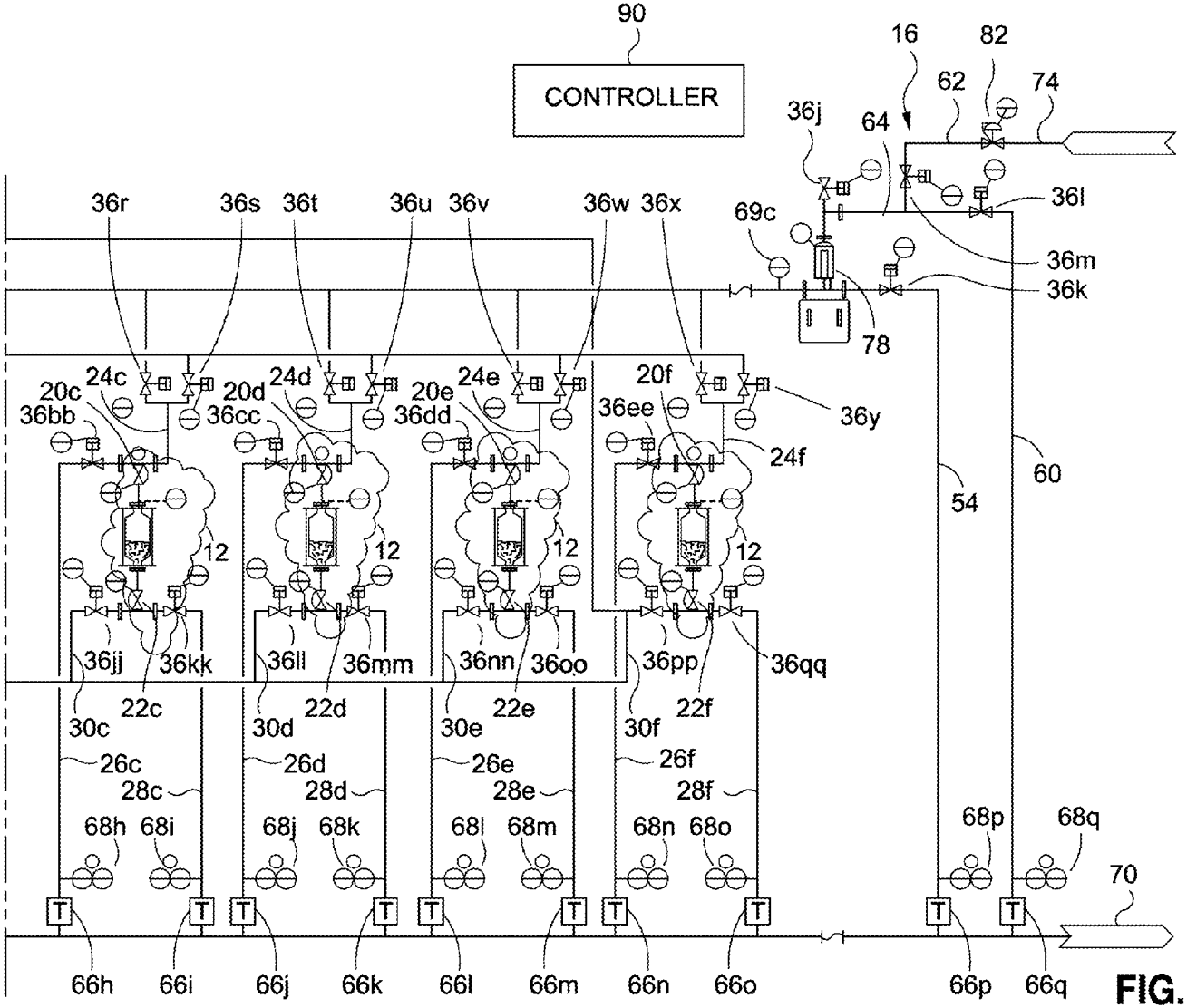

FIG. 1 illustrates a schematic view of a drug compounding skid 10 for sterile transfer of a compounded drug. The skid 10 includes a plurality of vessels 12, a sterilization system 14, and a drug transfer system 16. The skid 10 may also include a cleaning system 18 to allow the skid 10 to be cleaned in place.

Each vessel 12 is configured for a drug to be compounded within the vessel 12. The vessel 12 has an interior chamber for retaining the drug, and two open ends. The two open ends are positioned substantially opposite from each other. Each open end forms an entrance for the vessel 12, to allow a drug, or combination of drugs to be passed into the interior chamber.

The vessel 12 has sufficient strength to allow a drug to be compounded within the vessel 12. For example, the vessel 12 has sufficient strength to withstand forces applied to the vessel 12 by a drug compounding device. The drug compounding device may comprise a mill, or other form of agitator that may act upon the vessel 12 to compound a drug contained therein. In addition, the vessel 12 has sufficient strength to contain grinding beads that are configured to grind the drug when it is being compounded.

A first valve 20 is positioned at one of the open ends of the vessel 12. The first valves 20*a*, 20*b*, 20*c*, 20*d*, 20*e*, 20*f* may be collectively referred to as 20. Similarly, all other multiple reference numbers disclosed in this application, followed by a subsequent letter, may be collectively referred to by the preceding reference number. A second valve 22 is positioned at the other open end of the vessel 12. The first valve 20 and second valve 22 seal the interior chamber of the vessel 12 to prevent the drug contained within the vessel 12 from being released. In addition, the first valve 20 and second valve 22 may each be configured to form a sterile seal of the drug contained within the vessel 12, namely, the first and second valves 20, 22 may be structured to prevent microbes or microorganisms from easily passing through the valves 20, 22 and into the interior chamber. The valves 20, 22 may be configured to maintain the sterility of a drug contained within the vessel 12.

The vessel 12 is configured to be releasably joined to other components of the skid 10. The vessel 12 may be releasably coupled to conduits of the skid 10, including conduits 24, 26, 28, 30 of the sterilization system 14. The vessel 12 may be releasably coupled by the valves 20, 22 being joined to the conduits 24, 26, 28, 30 and also being capable of being released from the conduits 24, 26, 28, 30 to allow the entire vessel 12 to be released from the remaining portions of the skid 10.

The vessel 12 releasably joins with the other components of the skid 10 to allow the vessel 12 to be removed from the skid 10 and placed upon a separate drug compounding device, such as a mill. In this configuration, the drug compounding process takes place on a separate device. The vessel 12 with the compounded drug may be subsequently joined to conduits of the skid 10 to allow the compounded drug to be transferred out of the vessel 12 and to a holding tank 32.

The sterilization system 14 includes a sterilizing steam input 34, valves 35, 36, 38, and conduits 24, 26, 28, 30, 40, 42, 44, 46, 47, 48, 50, 52, 54, 56, 58, 60, 62, 64. The sterilization system may also include steam traps 66, thermal sensors 68 and pressure sensors 69.

The steam input 34 is configured to receive sterilizing steam from an outside source, for example, from a steam generator device. The steam generator device may include a heater, vaporizer, or the like. The steam input 34 may include a ball valve that is capable of being opened and closed to selectively allow steam to enter the conduit 40 from the outside source. A steam control valve 35 may also be used to control the rate at which steam enters the conduit 40.

The conduits 24, 26, 28, 30, 40, 42, 44, 46, 47, 48, 50, 52, 54, 56, 58, 60, 62, 64 may comprise pipes. The pipes may have sufficient strength to withstand the pressure of sterilizing steam being passed therethrough. The pipes may be constructed in a manner that they may be sterilized.

The valves 35, 36, 38 are configured to open or close to block the passage of steam or to allow steam to pass therethrough. In one embodiment, the valve 35 may comprise a sanitary control valve. The valves 36 may comprise a two-way directional valve. The valves 38 may each comprise a three-way directional valve. In one embodiment, the valves 36, 38 may each comprise a diaphragm valve. In one embodiment, the valves 36, 38 may each comprise a pneumatically actuated valve. In one embodiment, the valves 36, 38 may each comprise an electronically activated valve. In one embodiment, the valves 36, 38 may each comprise any combination of a diaphragm, pneumatically actuated, or electronically activated valve, as desired.

The thermal sensors 68 of the sterilization system 14 may be capable of detecting a temperature of the sterilizing steam used in the sterilization system 14. The thermal sensors 68 may be used to indicate when the temperature of the steam is too high or too low to effectively sterilize components of the skid 10, and may provide an indication to either increase a temperature of the steam input into the steam input 34, or to change a rate at which steam enters the steam input 34 or passes through the steam control valve 35.

The pressure sensors 69 of the sterilization system 14 may be capable of detecting a pressure of the sterilizing steam used in the sterilization system 14. The pressure sensors 69 may be used to indicate when a pressure of the steam is too high or too low to effectively sterilize components of the skid 10, and may provide an indication to either increase a pressure of the steam input into the steam input 34, or to change a rate at which steam enters the steam input 34 or passes through the steam control valve 35.

The sterilization system 14 is configured to pipe sterilizing steam throughout the conduits 24, 26, 28, 30, 40, 42, 44, 46, 47, 48, 50, 52, 54, 56, 58, 60, 62, 64 and through the valves 35, 36, 38 to sterilize the conduits 24, 26, 28, 30, 40, 42, 44, 46, 47, 48, 50, 52, 54, 56, 58, 60, 62, 64 and valves 35, 36, 38, and any other desired feature of the skid 10.

The sterilization system 14 may also be configured to sterilize the valves 20, 22 of each of the vessels 12. The sterilization system 14 may sterilize the valves 20, 22 if the valves 20, 22 are opened or closed. To sterilize the valves 20, 22 of each of the vessels 12 when the valves 20, 22 are closed, steam may be piped through the steam input 34, through the conduit 40, then through the conduit 42 until it passes through the conduit 24. The steam may then contact an outer surface of the valve 20 to sterilize the outer surface of the valve 20. In addition, the steam may be directed through the steam input 34, through the conduit 40, through the conduit 42, through the conduit 44, through the conduit 47 until it passes through the conduit 30. The steam may then contact an outer surface of the valve 22 to sterilize the outer surface of the valve 22.

The sterilization system 14 may also be configured to sterilize the interior chamber of each of the vessels 12 and an interior surface of the valves 20, 22 when either of the valves 20, 22 are open. To sterilize these parts of the skid 10, the steam may be piped through the conduit 40, through the conduit 42, through the conduit 24, through the valve 20, through the interior chamber of the vessel, and then through the valve 22. The steam may also pass through the conduit 26, and through conduit 28 and conduit 30 to sterilize these parts of the skid 10.

Upon sterilizing steam passing through the conduits 24, 26, 28, 30, 40, 42, 44, 46, 47, 50, 52, 54, 56, 58, 60, 62, 64 and through valves 35, 36, 38 of the skid, the steam may reach the steam traps 66. The steam traps 66 lock the sterilizing steam within the conduits 24, 26, 28, 30, 40, 42, 44, 46, 47, 50, 52, 54, 56, 58, 60, 62, 64 of the skid 10. Condensation produced from the sterilizing steam is collected within the steam traps 66 and is passed to the conduit 48. The conduit 48 conveys the condensation to a drain 70 for removal from the sterilization system 14.

The drug transfer system 16 includes a fluid inlet, or fluid inlets, which may include a water inlet 72, and an air inlet 74. The drug transfer system 16 also includes conduits 58, 42, 24, 30, 46, 47, 62, 64 and valves 36*c*, 36*d*, 36*e*, 36*f*, 36*g*, 36*h*, 36*i*, 36*j*, 36*k*, 36*l*, 36*m*, 36*n*, 36*o*, 36*p*, 36*q*, 36*r*, 36*s*, 36*t*, 36*u*, 36*v*, 36*w*, 36*x*, 36*y*, 36*ff*, 36*gg*, 36*hh*, 36*ii*, 36*jj*, 36*kk*, 36*ll*, 36*mm*, 36*nn*, 36*oo*, 36*pp*, 36*qq*, 36*rr*, 36*ss*, 36*tt*, and may include filters 76, 78, flow meters 80, a regulator 82, and pressure sensors 69.

The fluid inlets are configured to allow a fluid such as air or water to enter the inlet from an outside source. For example, the water inlet 72 is configured to receive water, preferably purified water, from an outside water source. The water inlet 72 allows the water to enter the conduit 58. The air inlet 74 is configured to receive air, preferably oil free air, from an outside air source. The outside air source preferably provides pressurized air, and may comprise an air compressor. The air inlet 74 allows the air to enter the conduit 62.

The water inlet 72 and air inlet 74 may operate in combination to transfer compounded drugs from the vessels 12 to the holding tank 32. The water inlet 72 may allow water to pass through the conduit 58, through the valves 36*e*, 36*f*, and through liquid filter 76. The water then passes through valve 36*i* and valves 36*o*, 36*q*, 36*s*, 36*u*, 36*w*, 36*y* to pass into conduit 24. If the valve 20 is open, then the water may enter the interior chamber of the vessel 12. If the valve 22 and valve 36*ff*, 36*hh*, 36*jj*, 36*ll*, 36*nn*, 36*pp*, are also open, then the water may flush out the drug compounded within the interior chamber. The water flushes the drug out to conduit 47, which passes through valves 36*ss*, 36*rr* to holding tank 32. The flow meters 80*a*, 80*b* may measure the flow of water through conduits 42, 47 respectively. The valves 36*c*, 36*d*, 36*g*, 36*j*, 36*k*, 36*l*, 36*gg*, 36*ii*, 36*kk*, 36*mm*, 36*oo*, 36*qq*, 36*tt*, 36*z*, 36*aa*, 36*bb*, 36*cc*, 36*dd*, 36*ee* are preferably closed during this operation.

The air inlet 74 is used to drive the fluid through the vessels 12 to allow it to enter the holding tank 32. The air inlet 74 may allow air to pass through the conduit 62 and through the valve 36*m* so that it passes through conduit 64 and conduit 46, and passes through valves 36*n*, 36*p*, 36*r*, 36*t*, 36*v*, 36*x*. The air drives the water through the conduit 24, and conveys it through the valve 20, through the interior chamber of the vessel 12, and through the valves 36*ff*, 36*hh*, 36*jj*, 36*ll*, 36*nn*, 36*pp*. The air conveys the water, and the drug through the conduit 47, through the valves 36*ss*, 36*rr* and to the holding tank 32. The valves 36*c*, 36*d*, 36*g*, 36*k*, 36*l*, 36*j*, 36*gg*, 36*ii*, 36*kk*, 36*mm*, 36*oo*, 36*qq*, 36*tt*, 36*z*, 36*aa*, 36*bb*, 36*cc*, 36*dd*, 36*ee* are preferably closed during this operation. The air passes through a filter 78 that scrubs particulate matter and microbes from the air. The regulator 82 may be used to control the air pressure passing through the conduits 62, 64, 46, 24, 30, 47. The pressure sensors 69 may be used to provide a measure of the fluid pressure passing through the conduits, to determine if the pressure should be lowered or raised as desired.

The cleaning system 18 includes a cleaning fluid inlet 84 that allows a cleaning fluid to enter the conduit 56. The cleaning fluid may comprise water, air, or a caustic fluid such as acid or the like. The cleaning fluid may be provided by a remote cleaning device, such as a cleaning skid. The cleaning fluid may pass through any of the valves 35, 36, 38, and conduits 24, 26, 28, 30, 40, 42, 44, 46, 47, 48, 50, 52, 54, 56, 58, 60, 62, 64. The cleaning fluid may also pass through the steam traps 66, filters 76, 78, flow meters 80, and regulator 82. A cleaning system return 86 may be coupled to a coupler 88 that is used to couple the holding tank 32 to the conduit 47. The cleaning system return 86 retrieves the cleaning fluid from the skid device 10 after the cleaning fluid has passed through the desired components of the skid device 10. The cleaning fluid preferably does not pass through any portion of the vessels 12. The vessels 12 are preferably cleaned while the vessels 12 are separate from the remaining portions of the skid device 10. Any of the inlets 34, 72, 74 or valves 35, 36, 38 may be closed or opened as desired during the cleaning operation to direct cleaning fluid to the desired portions of the skid device 10 to be cleaned.

In one embodiment, a controller device 90 may be configured to control inlets 72, 34, 84, 74 and/or valves 20, 22, 35, 36, 38 and/or regulator 82. In addition, the controller device 90 may be configured to receive a temperature reading from temperature sensors 68 and/or a pressure reading from pressure sensors 69. The controller device 90 may also be configured to receive a rate of flow reading from flow sensors 80. The controller device 90 may be configured to electrically and automatically open or close one or more of inlets 72, 34, 84, 74 and/or valves 20, 22, 35, 36, 38 and/or regulator 82 to operate any of the sterilization system 14, the drug transfer system 16, or the cleaning system 18. The controller device 90 may comprise an electrical controller device including a processor and memory, and capable of being programmed for operation. In one embodiment, the controller device 90 may comprise a dedicated controller designed to only perform certain tasks related to the sterilization system 14, the drug transfer system 16, or the cleaning system 18. The controller device 90 may be electrically wired to any component of the skid device 10 to provide for desired operation.

In a mode of operation in which the controller device 90 operates the sterilization system 14, the controller device 90 may open or close any of the valves 35, 36, 38 to allow sterilizing steam to sterilize any desired component of the skid device 10. The controller device 90 may receive a temperature reading from one of the temperature sensors 68 to determine if the temperature of the sterilizing steam is too high or too low, and may open or close one or more valves 35, 36, 38 to allow the temperature to reach a desired point. The controller device may also receive a pressure reading from one of the pressure sensors 69 to determine if the pressure of the sterilizing steam is too high or too low, and may open or close one or more valves 35, 36, 38 to allow the pressure to reach a desired point. In addition, the controller device 90 may operate to vary the temperature or pressure of the sterilizing steam by controlling the remote steam generation device. In one embodiment, the controller device 90 may send a signal for a user to vary the temperature or pressure of the sterilizing steam by controlling the remote steam generation device. In one embodiment, the controller device 90 may send a signal for a user to vary the temperature or pressure of the sterilizing steam by controlling the amount of steam passing through the steam inlet 34 and the steam control valve 35. The signal may comprise an alarm or the like.

In one embodiment, the controller device 90 may be configured to open or close one or more of valves 20, 22 to allow sterilizing steam to contact a desired portion of the vessels 12.

In a mode of operation in which the controller device 90 operates the drug transfer system 16, the controller device 90 may open or close any of the valves 36 and operate regulator 82 to allow fluid to convey a compounded drug contained within the vessel 12 to the holding tank 32. The controller device 90 may receive a flow reading from one of the flow sensors 80 to determine if the rate of flow of the fluid, including water and/or air is too high or too low, and may open or close one or more valves 36 or regulator 82 to allow the flow rate to reach a desired point. The controller device may also receive a pressure reading from one of the pressure sensors 69 to determine if the pressure of the fluid is too high or too low, and may open or close one or more valves 36 or regulator 82 to allow the fluid pressure to reach a desired point. In addition, the controller device 90 may operate to vary the flow rate and/or pressure of the fluid by controlling the remote water supply device and/or the air pressure device. In one embodiment, the controller device 90 may send a signal for a user to vary the flow and/or pressure of the fluid by controlling the water supply device and/or the air pressure device. In one embodiment, the controller device 90 may send a signal for a user to vary the flow rate and/or pressure of the air by controlling the amount of air passing through the air inlet 74 and the regulator 82. The signal may comprise an alarm or the like.

In one embodiment, the controller device 90 may be configured to open or close one or more of valves 20, 22 to allow fluid to convey a compounded drug contained within the vessel 12 to the holding tank 32

In a mode of operation in which the controller device 90 operates the cleaning system 18, the controller device 90 may open any of the valves 35, 36, 38 to allow a cleaning fluid to clean any desired component of the skid device 10. The controller device 90 may receive a flow reading from one of the flow sensors 80 to determine the rate of flow of the cleaning fluid, and may open or close one or more valves 35, 36, 38 to allow the flow rate to reach a desired point. In addition, the controller device 90 may operate to vary the flow rate of the cleaning fluid by controlling the remote cleaning device. In one embodiment, the controller device 90 may send a signal for a user to vary the flow of the cleaning fluid by controlling the remote cleaning device. The signal may comprise an alarm or the like.

Figure 2A:
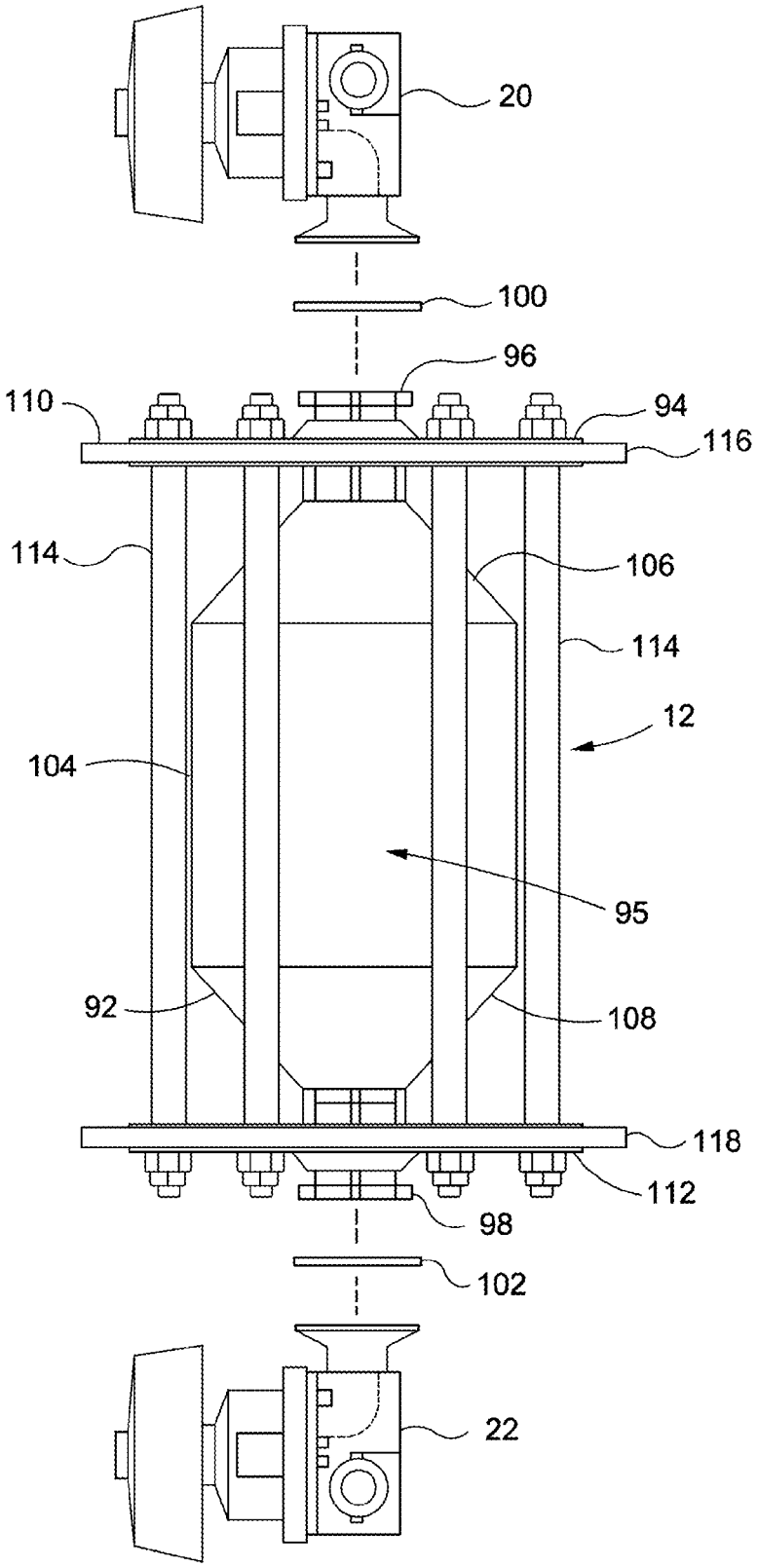
FIG. 2A is a side exploded view of components of a vessel according to an embodiment of the present invention.

FIG. 2A illustrates a side view of a vessel 12 for use with the drug compounding skid 10. The vessel 12 includes a vessel container 92 with a frame or vessel support 94 positioned around the container 92. The container 92 includes an interior chamber 95 with a first open end 96 and a second open end 98. The first valve 20 of the vessel 12 is positioned at the first open end 96 of the interior chamber 95. The second valve 22 of the vessel 12 is positioned at the second open end 98 of the interior chamber 95. A first filter 100 is positioned between the first valve 20 and the first open end 96 of the interior chamber 95. A second filter 102 is positioned between the second valve 22 and the second open end 98 of the interior chamber 95.

The vessel container 92 has a substantially cylindrically shaped middle portion 104 and two dome shaped end portions 106, 108. The middle portion 104 and end portions 106, 108 surround the interior chamber 95. The open ends 96, 98 are positioned at the dome shaped end portions 106, 108 and open into the interior chamber 95. The vessel container 92 is preferably made of glass, with strength sufficient to withstand a drug being compounded within the interior chamber 95. In other embodiments, the vessel container 92 may be made of any other material capable of allowing a drug to be compounded within the interior chamber 95.

The vessel support 94 includes a top plate 110, a bottom plate 112 and a plurality of supports 114 joining the top plate 110 to the bottom plate 112. The top and bottom plates 110, 112 are structured as substantially flat rigid disks. The top and bottom plates 110, 112 may include respective outer rims 116, 118 that are shaped substantially circular. The substantially circular shape of the outer rims 116, 118 allows the vessels 12 to be placed upon a mill and to rotate upon the mill if desired. The plates 110, 112 may include central openings that form the respective open ends 96, 98 of the interior chamber 95. The supports 114 comprise rod structures having one end joined to the top plate 110 and another end joined to the bottom plate 112. The supports 114 provide structural rigidity to the plates 110, 112 and serve to reduce the amount that the plates 110, 112 twist relative to the vessel container 92. The supports 114 reduce the amount that the plates 110, 112 twist relative to the vessel container 92 if the vessel 12 is rotating upon the mill.

The first valve 20 and second valve 22 are preferably mechanically joined to the respective open ends 96, 98 of the interior chamber 95 such that the valves 20, 22 are fixed to the container 92 when the vessel 12 is released from the conduits of the skid 10 as described in relation to FIG. 1. However, the valves 20, 22 may also be removable from the open ends 96, 98 to allow grinding beads or drugs to be inserted or removed from the interior chamber 95. The valves 20, 22 are preferably structured to produce a sterile seal of the interior chamber 95, and may comprise diaphragm valves or the like. In other embodiments, any other type of valve capable of forming a sterile seal of the interior chamber 95 may be used.

The filters 100, 102 are designed to prevent grinding beads that may be positioned within the interior chamber 95 from exiting the interior chamber 95. The filters 100, 102 preferably comprise mesh with apertures sized to allow the drug compounded within the interior chamber 95 to exit from the interior chamber 95, yet to not allow grinding beads to exit. The filters 100, 102 may be designed to be removable to allow grinding beads or drugs to be inserted or removed from the interior chamber 95. The filters 100, 102 may be removed when the valves 20, 22 are removed from the open ends 96, 98 of the interior chamber 95.

Figure 2B:
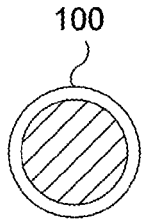
FIG. 2B is a top view of a filter according to an embodiment of the present invention.
Figure 2C:
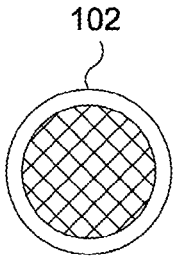
FIG. 2C is a top view of a filter according to an embodiment of the present invention.

FIG. 2B illustrates a top view of the filter 100. FIG. 2C illustrates a top view of the filter 102.

Figure 3C:
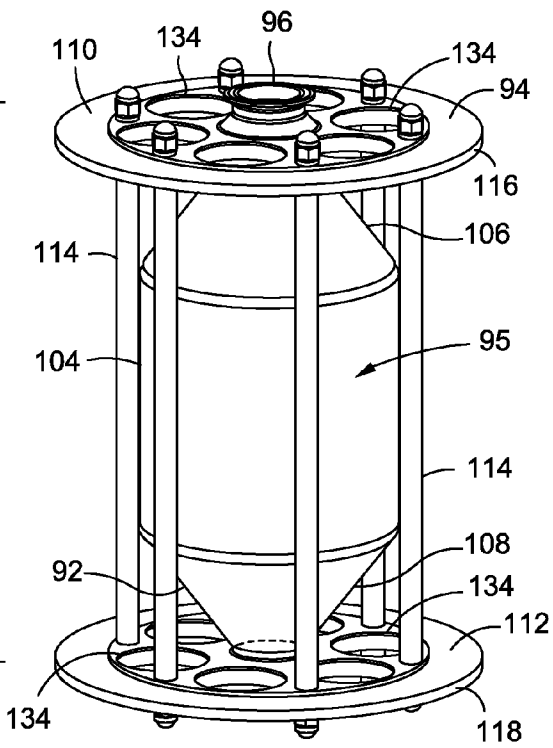
FIG. 3C is a perspective view of components of a vessel according to an embodiment of the present invention.
Figure 3B:
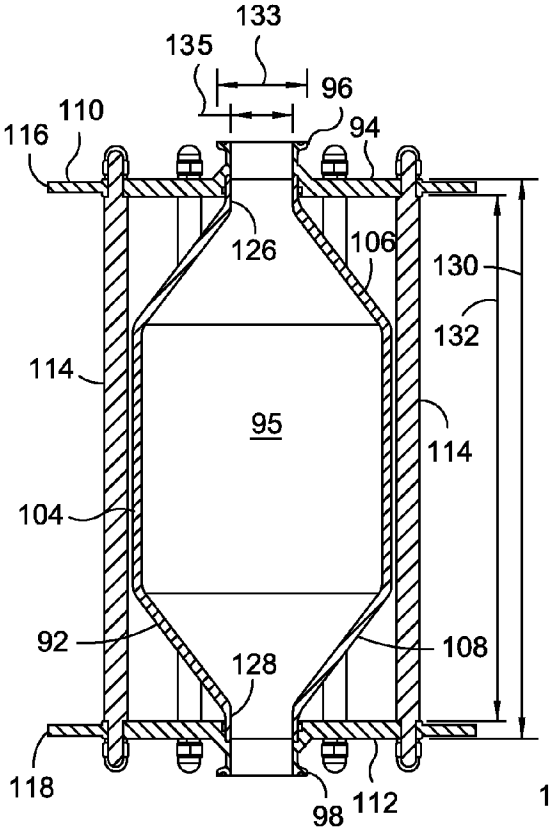
FIG. 3B is a side cross sectional view of components of a vessel according to an embodiment of the present invention.
Figure 3A:
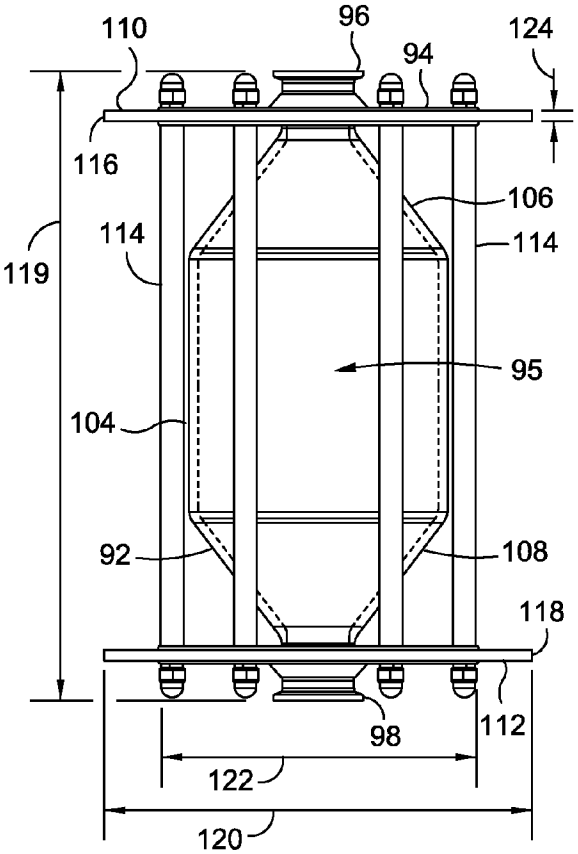
FIG. 3A is a side view of components of a vessel according to an embodiment of the present invention.

FIG. 3A illustrates a side close up view of the vessel container 92 and the vessel support 94. FIG. 3A illustrates the total length 119 of the vessel container 92 and vessel support 94, which may preferably have a size of approximately 354 millimeters. The total width 120 of the vessel container 92 and vessel support 94 may preferably have a size of approximately 240 millimeters. The width 122 distance between the supports 114 may preferably have a size of approximately 180 millimeters. The thickness 124 of one of the plates 110, 112 may preferably have a size of approximately 6 millimeters.

FIG. 3B illustrates a cross sectional close up side view of the vessel container 92 and the vessel support 94. FIG. 3B illustrates the interior chamber 95 is a hollow cavity surrounded by the walls of the substantially cylindrically shaped middle portion 104 and two dome shaped end portions 106, 108. The open ends 126, 128 of the vessel container 92 are joined with the plates 110, 112, and preferably form a sterile seal with the plates 110, 112. The open ends 126, 128 of the vessel container 92 lead into the open ends 96, 98 of the interior chamber 95.

FIG. 3B illustrates the length 130 between the exterior flat surfaces of the plates 110, 112, which may preferably have a size of approximately 313 millimeters. The length 132 between the interior flat surfaces of the plates 110, 112 may preferably have a size of approximately 293 millimeters. The outer width 133 of one of the open ends 96, 98 of the interior chamber 95 may preferably have a size of approximately 50 millimeters. The interior width 135 of one of the open ends 96, 98 of the interior chamber 95 may preferably have a size of approximately 35 millimeters.

FIG. 3C illustrates a close up perspective view of the vessel container 92 and the vessel support 94. FIG. 3C illustrates a plurality of apertures 134 extend through the top plate 110 and the bottom plate 112. The apertures 134 are sized to reduce the weight of the vessel support 94, to allow the vessel container 92 and vessel support 94 to be more easily transported, and to improve rotation of the vessel support 94 on a mill if desired.

Figure 4A:
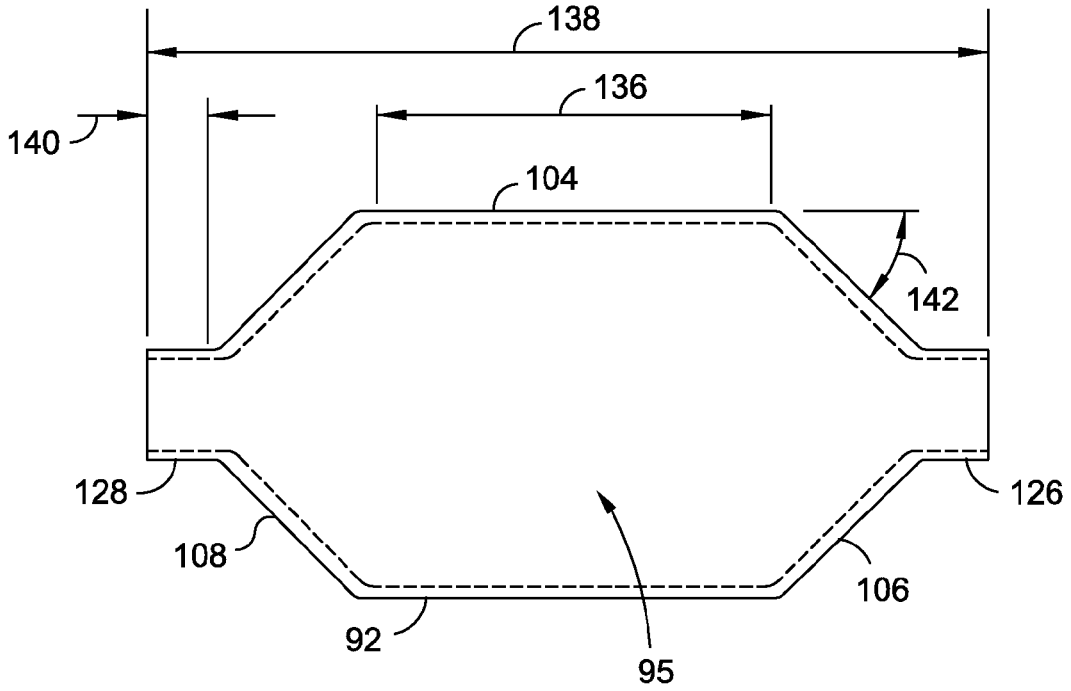
FIG. 4A is a side schematic view of components of a vessel according to an embodiment of the present invention.

FIG. 4A illustrates a side schematic view of the vessel container 92 with the vessel support 94 (shown in FIG. 2A) removed. The length 136 of the middle portion 104 may preferably have a size of approximately 146 millimeters. The length 138 of the entire vessel container 92 may preferably have a size of approximately 312 millimeters. The length 140 from the end of the end portions 106, 108 to the end of the open ends 126, 128 of the vessel container 92 may preferably have a size of approximately 13 millimeters. The dome shaped end portions 106, 108 angle from the middle portion 104 preferably at an angle 142 of approximately forty five degrees.

Figure 4B:
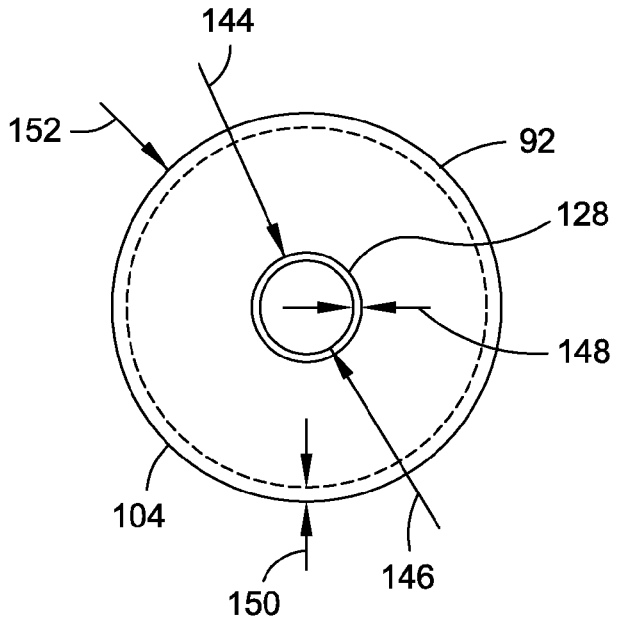
FIG. 4B is an end view of components of a vessel according to an embodiment of the present invention.

FIG. 4B illustrates an end schematic view of the vessel container 92. The open end 128 of the vessel container 92 may preferably have an outer diameter 144 of approximately 41 millimeters, and an inner diameter 146 of approximately 34 millimeters. The wall of the open end 128 of the vessel container 92 may preferably have a diameter 148 of approximately 2.5 millimeters. The wall of the middle portion 104 of the vessel container 92 may preferably have a diameter 150 of approximately 5 millimeters. The vessel container 92 may preferably have an outer diameter 152 of approximately 145 millimeters.

Figure 5A:
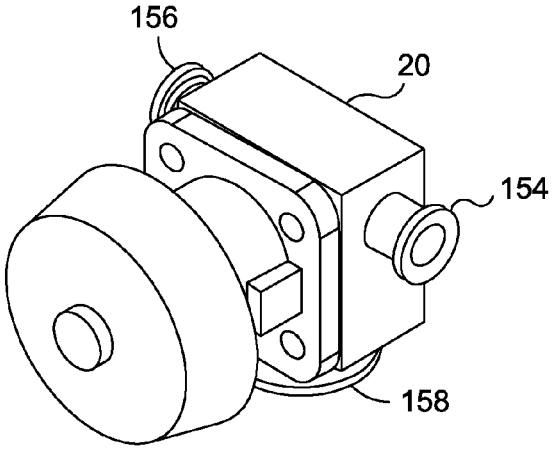
FIG. 5A is a perspective view of a valve according to an embodiment of the present invention.

FIG. 5A illustrates a perspective view of the valve 20 shown in FIG. 2A. The valve 20 is structured and operates identically as the valve 22 shown in FIG. 2A. The valve 20 includes outer ports 154, 156 and an inner port 158. The outer port 154 is configured to be releasably joined with the conduit 24 shown in FIG. 1. The outer port 156 is configured to be releasably joined with the conduit 26 shown in FIG. 1. The inner port 158 is configured to be fixed to the open end 96 of the interior chamber 95 shown in FIG. 2A for example. The ports of the valve 22 shown in FIG. 2A respectively join to the conduits 28, 30 shown in FIG. 1, and the open end 98 of the interior chamber 95.

Figure 5B:
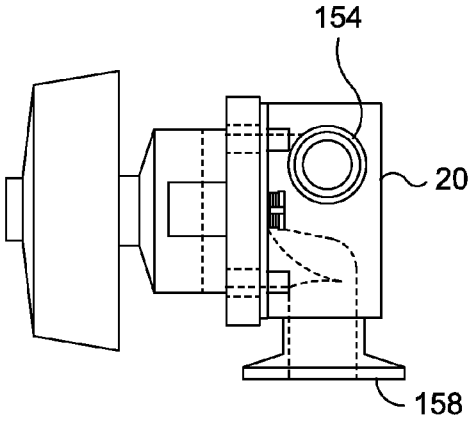
FIG. 5B is a side view of a valve according to an embodiment of the present invention.
Figure 5C:
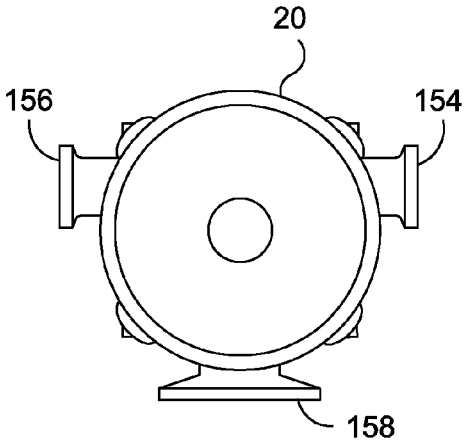
FIG. 5C is a front view of a valve according to an embodiment of the present invention.
Figure 5D:
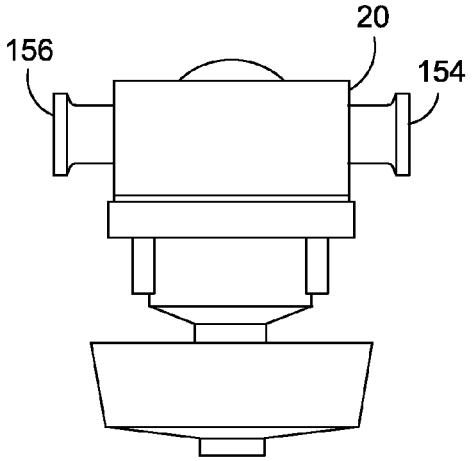
FIG. 5D is a top view of a valve according to an embodiment of the present invention.

FIG. 5B illustrates a side view of the valve 20. FIG. 5C illustrates a front view of the valve 20. FIG. 5D illustrates a top view of the valve 20.

Figure 6A:
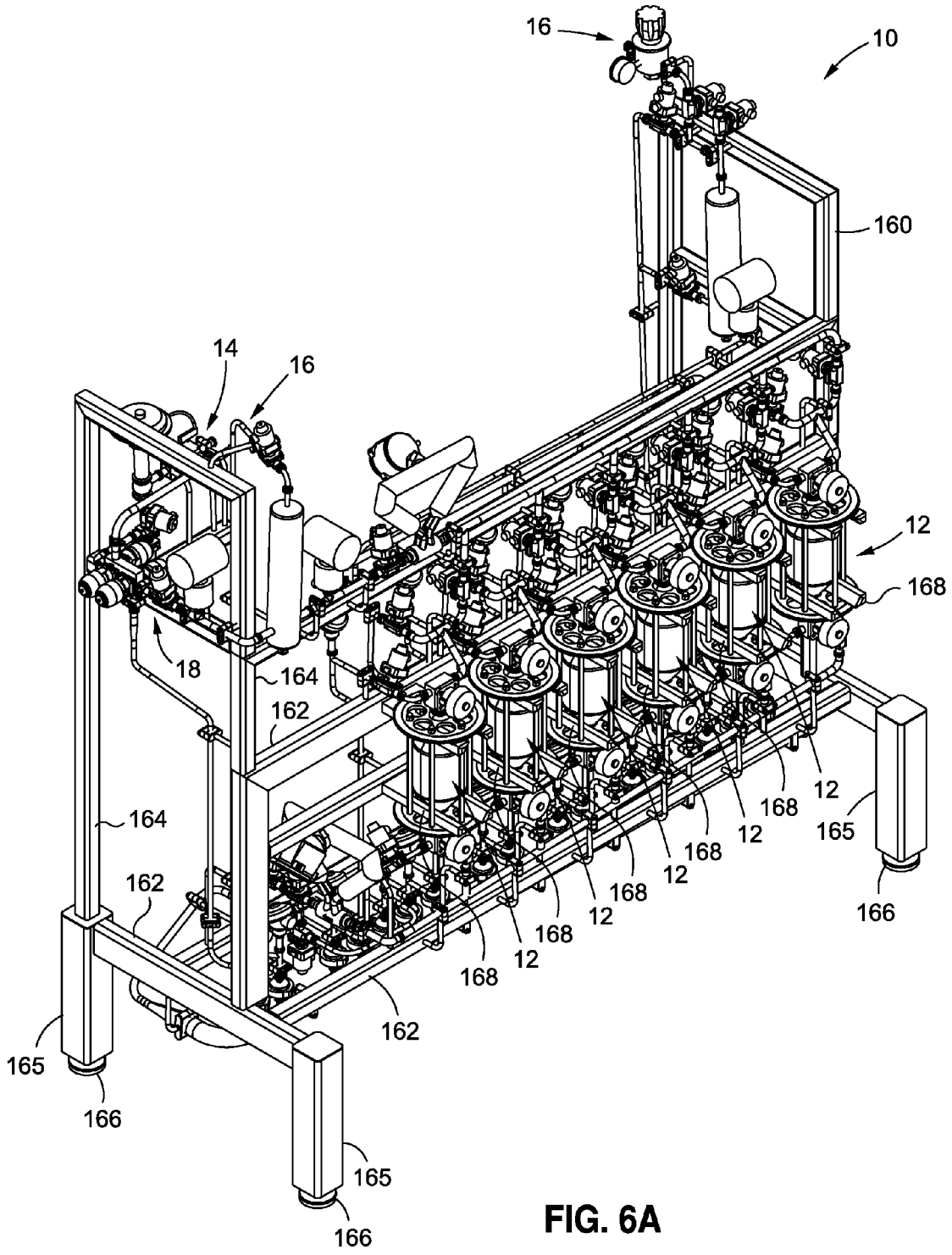
FIG. 6A is a front perspective view of a drug compounding skid according to an embodiment of the present invention.

FIG. 6A illustrates a front perspective view of the drug compounding skid 10 that is shown in schematic view in FIG. 1. Components of the drug compounding skid 10, including the vessels 12, the sterilization system 14, and the drug transfer system 16 may be attached to a frame 160 that is configured to stand upon a supporting surface. The cleaning system 18 may also be attached to the frame 160.

The frame 160 includes a plurality of horizontally extending bars 162 joined to a plurality of vertically extending bars 164. The horizontally extending bars 162 and vertically extending bars 164 have sufficient strength to support the weight of the vessels 12, the sterilization system 14, the drug transfer system 16, and the cleaning system 18 as desired. Feet 166 are positioned at the lower end of frame legs 165. The feet 166 are configured to rest upon a supporting surface as desired.

The frame 160 includes vessel holders 168 in the form of prongs that extend outward from the frame 160. The vessel holders 168 are shaped to pass in between the plurality of supports 114 that join top plate 110 of the vessel 12 to the bottom plate 112 as shown in FIG. 2A. The vessel holders 168 contact the two dome shaped end portions 106, 108 of the vessel container 92 shown in FIG. 2A to secure the vessel 12 in position. The vessel holders 168 are configured such that the vessel 12 may be slid on and off of the vessel holders 168 when the vessel 12 is joined or released from the frame 160. The vessel holders 168 bear and transmit the weight of the vessel to the frame 160. The vessel holders 168 may be shaped to include a tapered edge that matches the angle of the dome shaped end portions 106, 108. The shape of the tapered edge provides a secure fit between the vessel 12 and the frame 160.

Figure 6B:
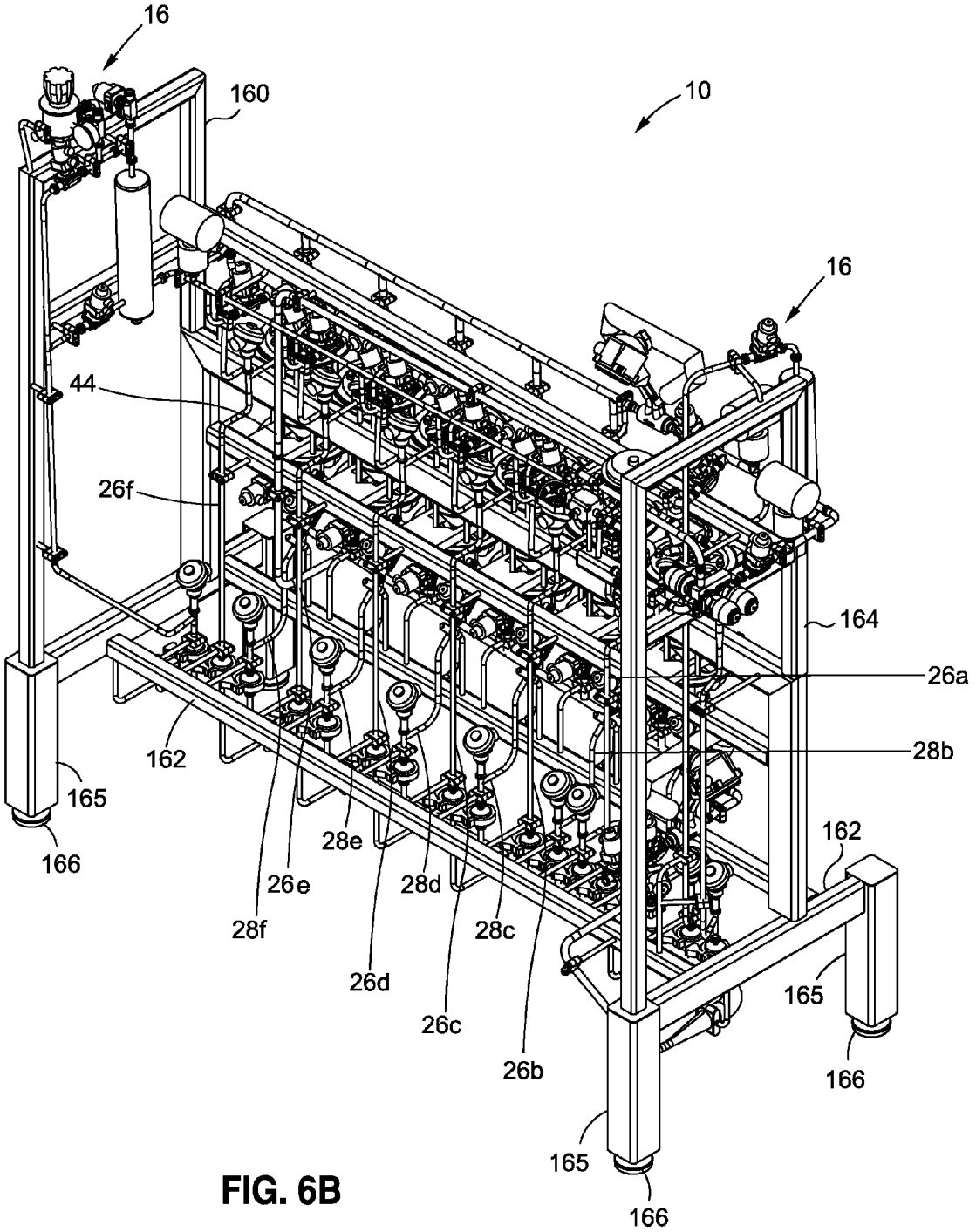
FIG. 6B is a rear perspective view of the drug compounding skid shown in FIG. 6A according to an embodiment of the present invention.

FIG. 6B illustrates a rear view of the frame 160 illustrating the connections between the plurality of horizontally extending bars 162 and the plurality of vertically extending bars 164.

Figure 6C:
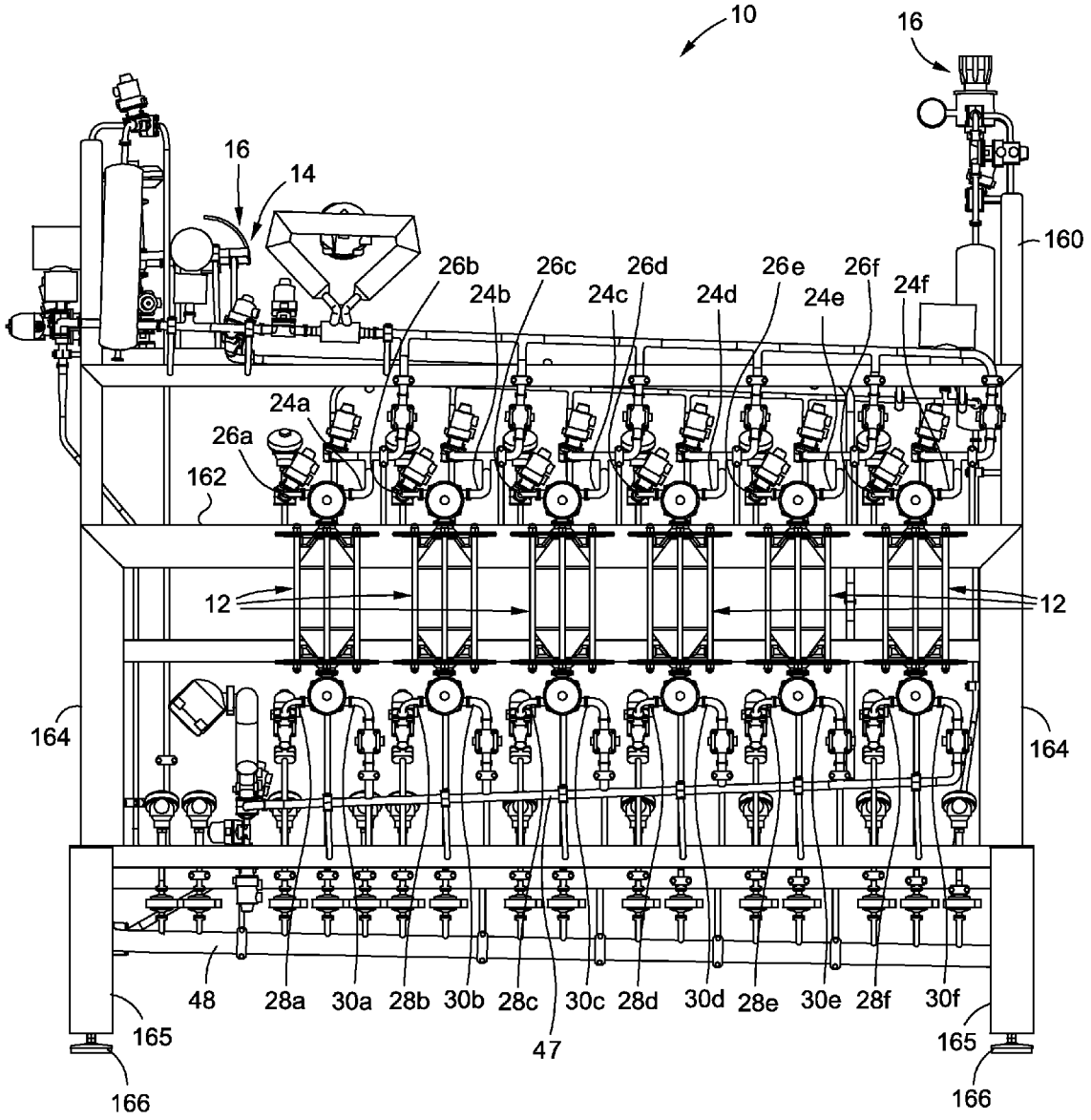
FIG. 6C is a front view of the drug compounding skid shown in FIG. 6A according to an embodiment of the present invention.
Figure 6D:
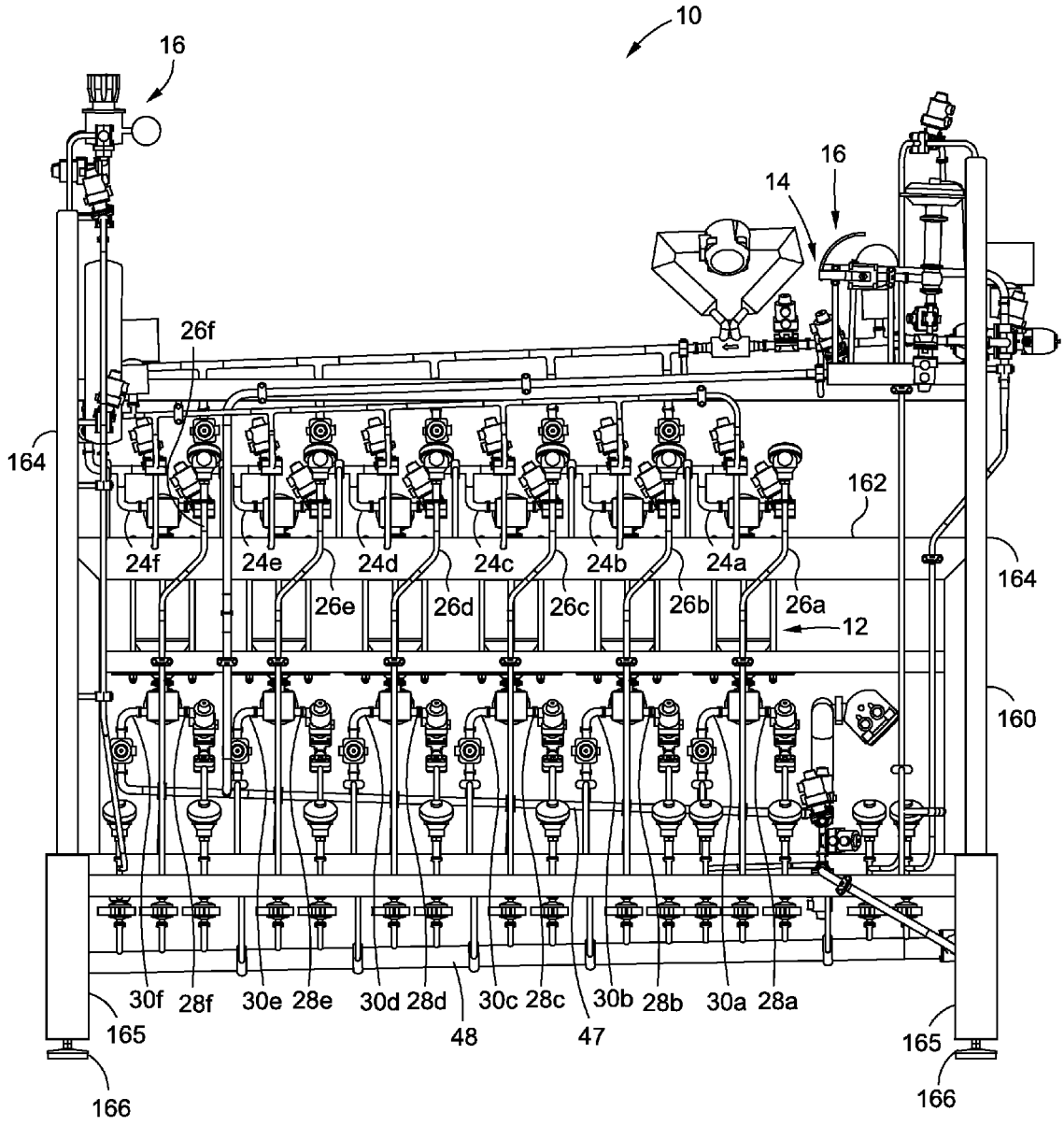
FIG. 6D is a rear view of the drug compounding skid shown in FIG. 6A according to an embodiment of the present invention.

FIG. 6C illustrates a front view of the frame 160 illustrating the connections between the plurality of horizontally extending bars 162 and the plurality of vertically extending bars 164. In addition, the connections between the conduits 24, 26, 28, 30 and the valves of the vessels 12 are also shown in accordance with the schematic shown in FIG. 1. FIG. 6D illustrates a rear view of the frame 160.

Figure 6E:
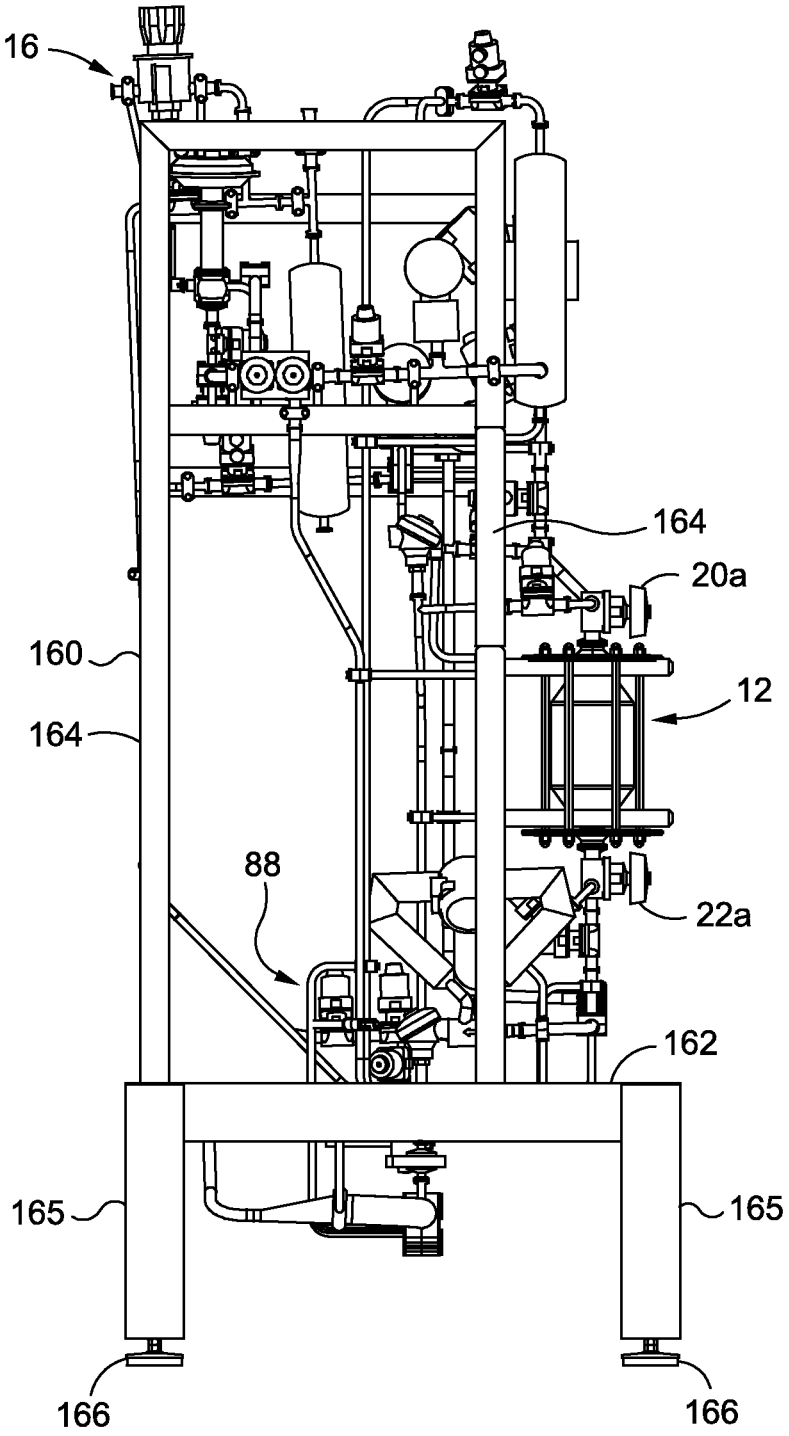
FIG. 6E is a left side view of the drug compounding skid shown in FIG. 6A according to an embodiment of the present invention.

FIG. 6E illustrates a left side view of the frame 160. The coupler 88 is visible that is used to couple the holding tank 32 (shown in FIG. 1) to the conduit 47 (shown in FIG. 6C).

Figure 6F:
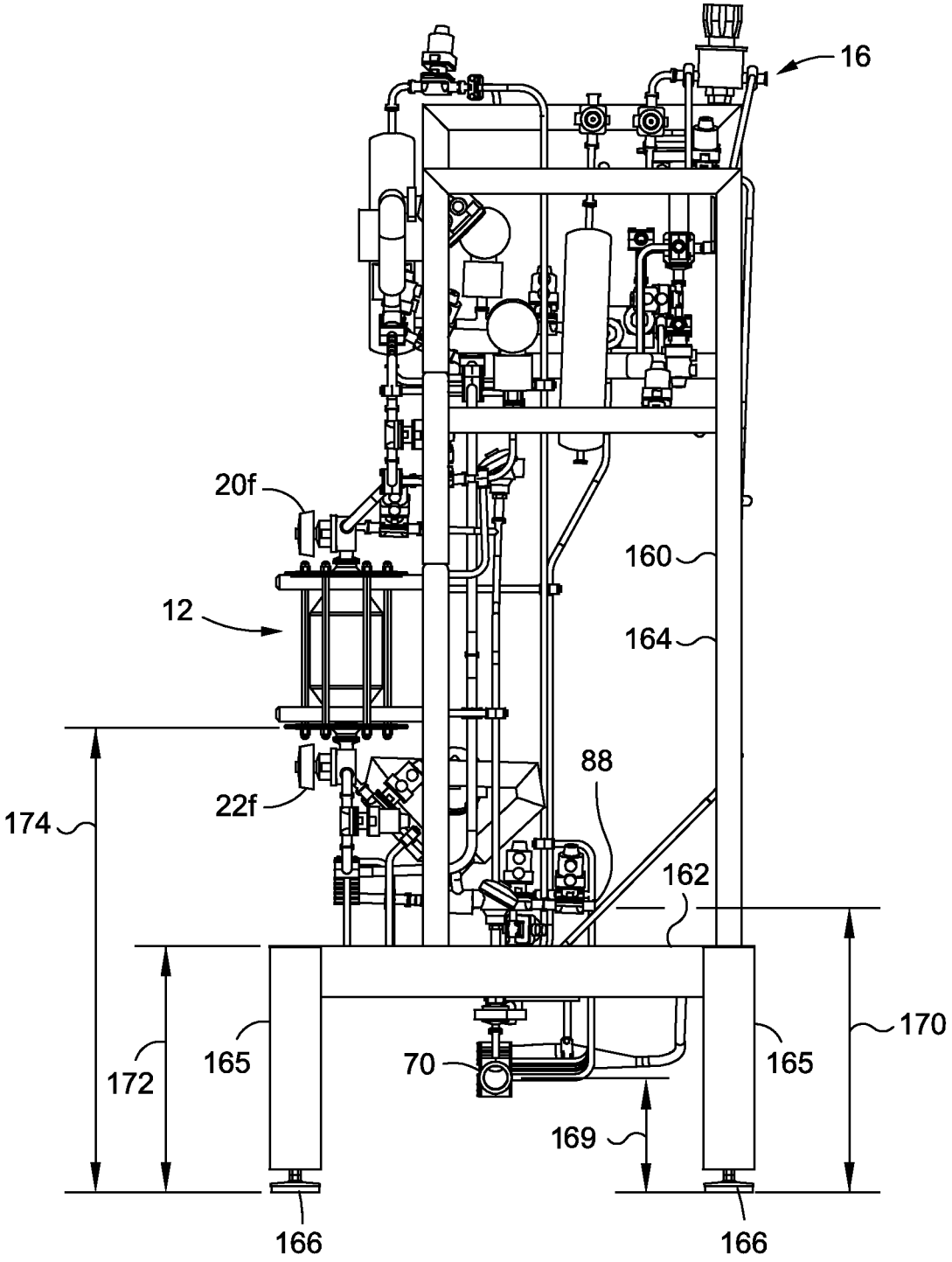
FIG. 6F is a right side view of the drug compounding skid shown in FIG. 6A according to an embodiment of the present invention.

FIG. 6F illustrates a right side view of the frame 160. The drain 70 that conveys condensation for removal from the sterilization system 14 (as described in regard to FIG. 1) is visible. A height 169 of the drain 70 above a supporting surface may preferably be approximately nine inches. A height 170 of the coupler 88 above a supporting surface may preferably be approximately 22 inches. A height 172 of a horizontal support bar 162 above a supporting surface may preferably have a size of approximately 19 inches. A height 174 of a bottom plate 112 (shown in FIG. 2A) of a vessel 12 may preferably have a size of approximately 36 inches.

Figure 6G:
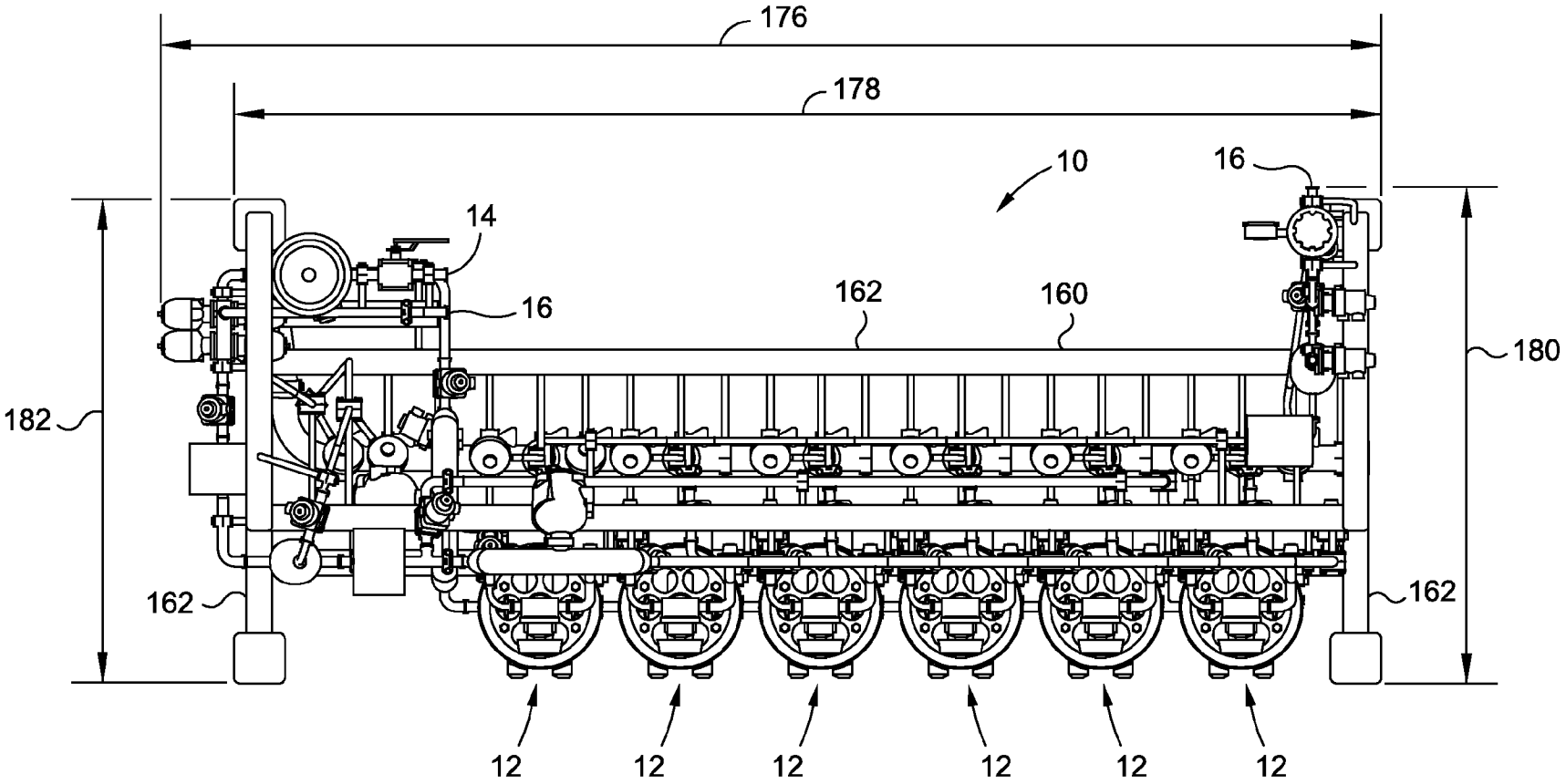
FIG. 6G is a top view of the drug compounding skid shown in FIG. 6A according to an embodiment of the present invention.

FIG. 6G is a top view of the frame 160. The skid 10 may preferably have an outermost length 176 of approximately 96 inches. The frame 160 may preferably have a length 178 of approximately 90 inches. The skid 10 may preferably have an outermost width 180 of approximately 39 inches, accounting for the air inlet of the drug transfer system 16. The frame 160 may preferably have a width 182 of approximately 38 inches.

In operation, the skid 10 allows for sterile transfer of a compounded drug. Components of the skid 10 may be utilized in any manner as desired, however, an exemplary method of operation is as follows. Referring to FIG. 1, a vessel 12 may be removed from the skid 10 and filled with a drug to be compounded and/or any other substance as desired. Preferably, grinding beads are additionally placed within the vessel 12 to assist to further agitate the drug within the vessel 12. The drug to be compounded and/or any other substance is preferably inserted into the interior chamber 95 through the first open end 96 and/or the second open end 98 of the interior chamber 95 as shown in FIG. 2A. The valves 20, 22 and filters 100, 102 shown in FIG. 2A are preferably removed to allow material to be placed within the interior chamber 95. Once the desired materials are positioned within the interior chamber 95, the valves 20, 22 and filters 100, 102 shown in FIG. 2A are joined with the first and second open ends 96, 98 of the interior chamber 95.

Referring back to FIG. 1, the vessel 12, which includes the drug to be compounded, is then joined to the skid 10. In the embodiment shown in FIG. 1, up to six vessels 12 may be joined to the skid 10 at one time. The valves 20, 22 of each vessel 12 are preferably opened. The sterilization system 14 is then activated to direct sterilizing steam to contact and sterilize the interior of the valves 20, 22 and the interior chambers 95 of the vessels 12 shown in FIG. 2A. Any drug, grinding bead, or other desired material within the vessel 12 is additionally sterilized. The sterilization system 14 may be operated manually, or may be operated automatically through use of the controller device 90.

The valves 20, 22 are closed after the sterilization system 14 sterilizes the interior of the valves 20, 22, and the interior chamber 95. The valves 20, 22 form a sterile seal of the drug to be compounded within the interior chamber 95. The valves 20, 22 are then released from the conduits 24, 26, 28, 30 to allow the vessels 12 to release from the skid 10. Each vessel 12 is portable and may be physically carried to a separate compounding device.

In an embodiment in which the compounding device is a mill, then each vessel 12 will be placed on the mill such that the outer rims 116, 118 of the top and bottom plates 110, 112 (shown in FIG. 2A) roll upon the mill. While each vessel 12 is on the mill, the valves 20, 22 remain closed to maintain the sterile seal of the drug within the interior chamber 95. The vessel 12 may be left on the mill for any desired duration necessary to compound the drug within the vessel 12. The grinding beads may serve to provide further agitation for the drug that is compounded within the vessel 12.

After drugs have been compounded in as many vessels 12 as desired, the vessels 12 are joined back onto the skid 10. The valves 20, 22 remain closed while the vessels 12 are joined back onto the skid 10. The vessels 12 are joined to the skid by connecting the conduits 24, 26, 28, 30 back to the respective valves 20, 22. Before the valves 20, 22 are reopened, the sterilization system 14 is activated to direct sterilizing steam to contact and sterilize the exterior portions of the valves 20, 22. The exterior portions of the valves 20, 22 are preferably sterilized to eliminate any microbe or other aseptic materials that may have been encountered on the exterior portions of the valves 20, 22 while on the compounding device. The exterior portions of the valves 20, 22 to be sterilized may include the respective outer ports 154, 156 (shown in FIGS. 5A-5D) of each valve 20, 22. The process of sterilizing the exterior portions of the valves 20, 22 may also sterilize the conduits utilized with the drug transfer system 16.

Upon the exterior portions of the valves 20, 22 being sterilized, the drug transfer system 16 is activated to provide an overpressure of air via the air inlet 74. The air overpressure prevents microbes or other aseptic materials from being drawn into the piping of the drug transfer system 16 from the outside environment of the skid 10. The valves 20, 22 are then opened to the sterile environment of the piping of the drug transfer system 16. The drug transfer system 16 is then activated to direct fluid such that it passes through the first valve 20, then through the interior chamber 95 (shown in FIG. 2A) of each of the vessels 12, and then through each of the second valves 22. In one embodiment, the fluid used by the drug transfer system 16 may be air from the air inlet 74. In one embodiment, the fluid used by the drug transfer system 16 may be water or other liquid from the water inlet 72. In one embodiment, the fluid used by the drug transfer system 16 may include a combination of water or other liquid from the water inlet 72 and air from the air inlet 74. In this embodiment the liquid may be delivered through the piping of the drug transfer system 16 such that it flows towards each vessel 12. The liquid may contact the compounded drug to convey it away from the interior chamber 95 (shown in FIG. 2A) and any grinding beads contained therein. The air from the air inlet 74 may then have its pressure increased to provide a motive pressure against the liquid, to further drive the liquid away from the interior chamber 95 and the grinding beads.

Upon the compounded drug being directed away from the interior chamber 95 (shown in FIG. 2A), the air and/or liquid utilized by the drug transfer system 16 conveys the drug down the conduit 47. Preferably, the compounded drug is delivered to the holding tank 32. The holding tank 32 serves as a bulk storage unit for all compounded drug delivered from the vessels 12.

After the compounded drug is passed to the holding tank 32 as desired, the skid 10 may be cleaned. During cleaning, each vessel 12 is removed from the remaining portions of the skid 10. Each vessel 12, including the interior chamber 95 and valves 20, 22 (shown in FIG. 2A) may be cleaned separate from the skid 10.

A separate cleaning device, or cleaning skid, may be attached to the skid 10 to clean the respective components and piping. An output of the cleaning device may be joined to the cleaning fluid inlet 84. An input of the cleaning device may be joined to the skid 10 at the coupler 88. The holding tank 32 may be decoupled from the coupler 88 and a separate cleaning system return 86 may be joined to the coupler 88 to serve as an input for the cleaning system. The cleaning system 18 may then be operated to clean the conduits of the sterilization system 14 and the drug transfer system 16 as desired.

After the vessels 12 and components of the sterilization system 14 and drug transfer system 16 have been cleaned to the desired degree, then the skid 10 may be prepared to compound another drug.

Figure 7A:
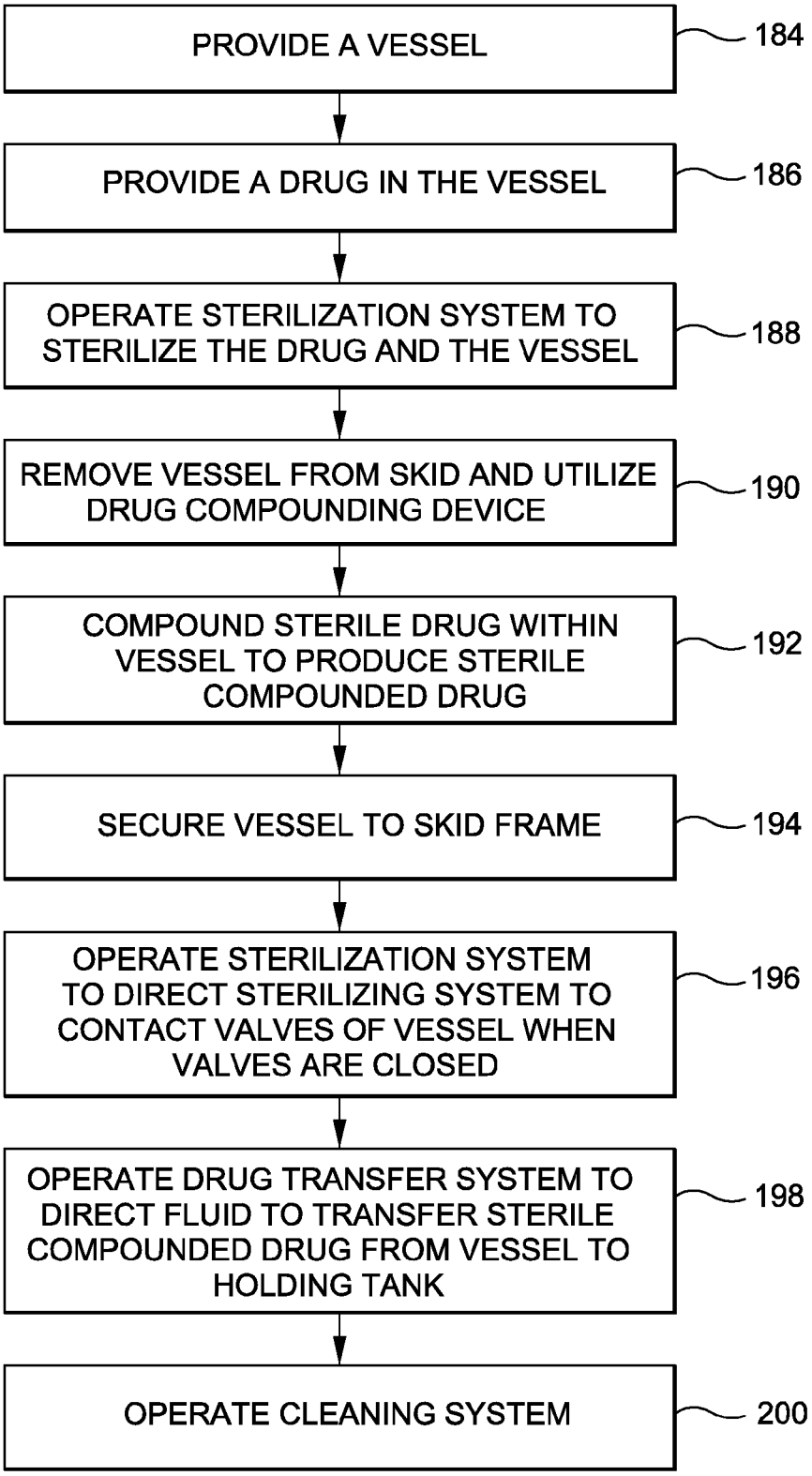
FIG. 7A is a flow chart of a method of utilizing a drug compounding skid according to an embodiment of the present invention.

FIG. 7A illustrates an exemplary method of operating the skid 10. The steps shown in FIG. 7A may be used in lieu or in combination with any other method of operation discussed in this application regarding the skid 10. Any step may be omitted if effective to produce a desired result. The method may include providing 184 a vessel, which may include any of the vessels 12 discussed in this application. A drug may then be provided 186 in the vessel 12 for compounding.

The vessel 12 may then be joined with the sterilization system 14 and the sterilization system 14 may be operated 188 to sterilize the vessel 12 and the drug contained within the vessel. Upon the vessel 12 and the drug being sterilized, the valves 20, 22 of the vessel 12 are closed to form a sterile seal of the sterile drug within the interior chamber 95 of the vessel (shown in FIG. 2A).

The vessel 12 is then removed 190 from the skid 10 and a drug compounding device is utilized. In an embodiment in which the drug compounding device is a mill, the vessel 12 is then placed on the mill.

The mill is operated to compound 192 the sterile drug to produce a sterile compounded drug.

After the sterile compounded drug has been produced, the vessel 12 is then secured 194 to the frame 160 shown in FIGS. 6A-6G.

The sterilization system 14 is operated 196 to direct sterilizing steam to contact and sterilize the first valve 20 and the second valve 22 when the first valve 20 and second valve 22 are closed.

The drug transfer system 16 is then operated 198 to direct fluid through the first valve 20 when the first valve 20 is open, then through the interior chamber 95 (shown in FIG. 2A), and then through the second valve 22 when it is open, to transfer the sterile compounded drug from the interior chamber 95 to a holding tank 32.

The cleaning system 18 may then be operated 200 to clean desired conduits of the sterilization system 14 and the drug transfer system 16.

The steps discussed in regard to FIG. 7A, or otherwise discussed in this application may be aided through use of the controller device 90. The controller device 90 may be utilized to automate the operation of components of the sterilization system 14, the drug transfer system 16, and/or the cleaning system 18 as desired.

The skid 10 beneficially allows a drug to be compounded and transferred without exposing the drug to an aseptic environment. The skid 10 may enhance the ease of operation to provide a sterile environment for production of drugs.

Figure 7B:
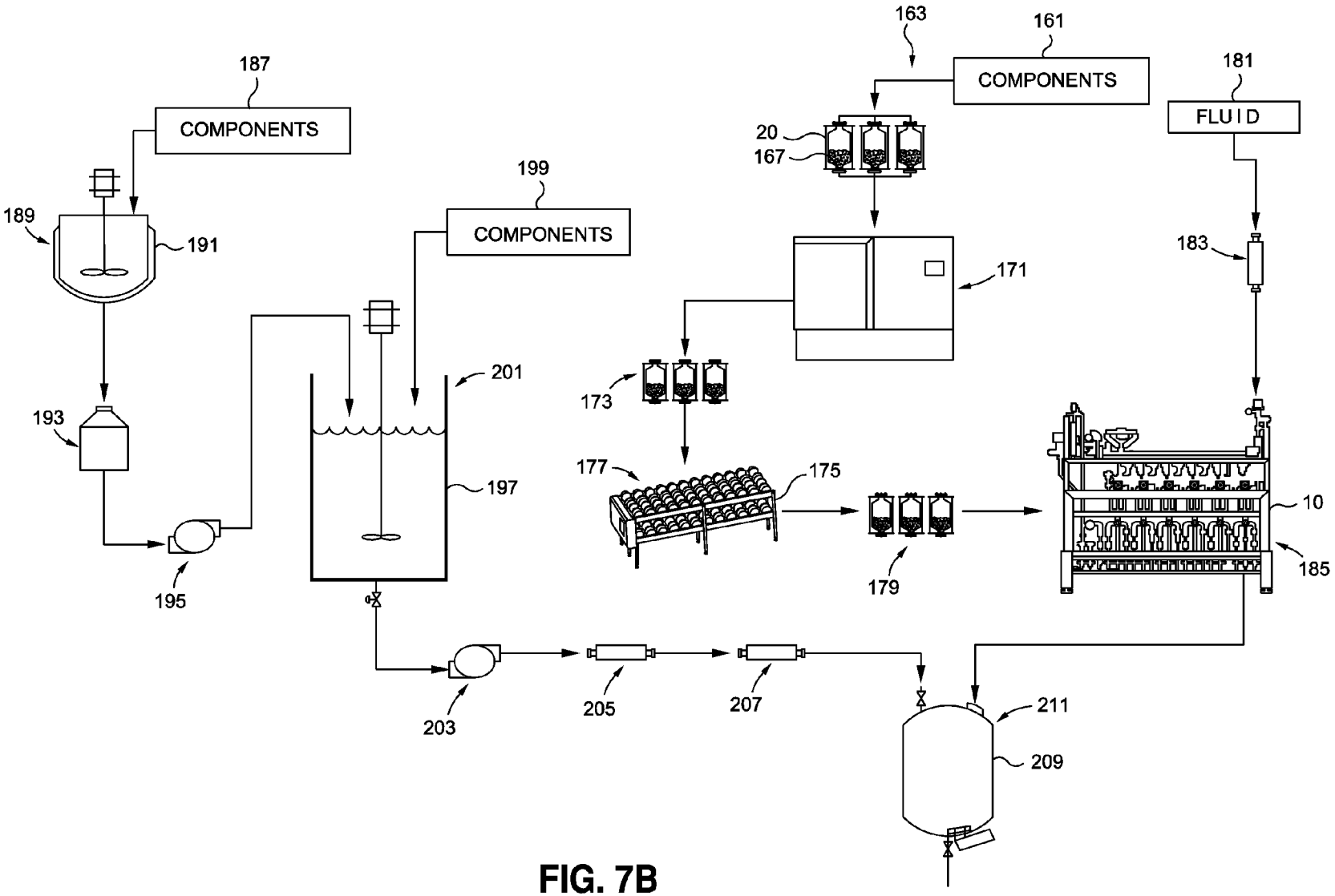
FIG. 7B is a process schematic illustrating a method of utilizing a drug compounding skid according to an embodiment of the present invention.

In one embodiment, steps of a method of using the skid 10 may be used in a process that combines various components to produce a desired compounded drug output. For example, the output from the skid 10 may be combined with various other components to produce a desired product. FIG. 7B illustrates a process schematic showing output from the skid 10 combined with components from other processing steps. In this embodiment, components 161 may include drugs, grinding beads, water and/or other components for compounding within a vessel 20. The components 161 may be passed 163 into an interior of the vessels 20. FIG. 7B illustrates the grinding beads 167 present within the vessels 20. The components 161 may be compounded at this stage if desired. In one embodiment, the components 161 may be compounded or milled for approximately 10-30 minutes if desired.

Upon the components 161 being milled for the desired duration, the interior of the vessel 20, including the components 161 may be sterilized 171. The sterilization process may occur by the vessels 20 being fixed to the skid 10 and being sterilized in a process identified as step 188 in FIG. 7A. In the embodiment shown in FIG. 7B, however, the sterilization process occurs separate from the skid 10, in an autoclave. The vessel 20 and components 161 may be sterilized for any duration and at any temperature as desired. In one embodiment, the sterilization process may occur for approximately 165-180 minutes at no less than approximately 121.1 degrees Celsius.

The sterilized vessel 20 and components 161 may then be cooled 173 to return to room temperature. The cooled vessel 20 may then be placed upon a compounding device 175 which may comprise a mill as shown in FIG. 7B. The components 161 within the vessel 20 are then compounded 177 upon the compounding device 175 for any duration as desired. In one embodiment, the compounding process may occur for approximately 168-196 hours. Upon the components 161 being compounded, the vessels 20 may be joined 179 to the skid 10.

The compounded components 161, excluding the grinding beads, may then be extracted from the vessels 20, in a process identified as steps 196 and 198 in FIG. 7A. The fluid used in the water inlet 72 shown in FIG. 1 may derive from a fluid source 181 that passes through a sterilizing filter 183. The compounded components 161 may pass through a conduit to a sterile mixing tank 209.

At a time during, after, or prior to the components 161 from the skid 10 entering the sterile mixing tank 209, separate components 187, including drugs, water, and/or other components for use in a drug product may be passed into a sterile mixing tank 191. The components 187 may be mixed 189 in the tank 191 for any duration or temperature as desired. In one embodiment, the components 187 may be mixed at a temperature between approximately 85 to 90 degrees Celsius.

Upon the components 187 being mixed to the desired degree, the components may be passed and held in bottles 193 where they are stored and cooled for a desired duration. In one embodiment, the components 187 may be cooled to a temperature of approximately 15 to 30 degrees Celsius before they are passed into the bottles. Once in the bottles, the components 187 may be further cooled to approximately 15 degrees Celsius for a time less than approximately 12 hours.

Once the components 187 are cooled in the bottles 193 to the desired degree, they may be pumped 195 via a pump to another sterile mixing tank 197. The sterile mixing tank 197 may include additional components 199, which may include drugs, water, and/or other components for use in a drug product. The components 187 may be combined with the additional components 199 within the tank 197 and may be mixed within the tank 197 to a desired degree.

The combined components 187, 199 may then be pumped 203 via a pump through a pre-filter 205 and sterilizing filter 207. The components 187, 199 may pass into the sterile mixing tank 209 in which the components 187, 199 may be joined with the components 161 delivered from the skid 10.

The combined components 187, 199, 161 may be mixed in the sterile mixing tank 209 to a desired degree. The components 187, 199, 161 may then be passed to another processing area for addition of further components and/or other processing, or may be passed to a filling area for a filling process, in which the combined components 187, 199, 161 are bottled in a sterile process for end use.

The components 187, 199, 161 may be passed into the sterile mixing tank 209 in any order as desired. For example, in one embodiment, the components 187, 199 may be held in the tank 209 for mixing prior to the components 161 being passed into the tank 209. The processes shown in FIG. 7B may be conducted in a sterile environment, including a Class 10,000 area if desired. Any process shown in FIG. 7B may be modified, omitted, or performed in a different sequence so long as a desired end product results. The processes shown in FIG. 7B may additionally be used in combination with any skid apparatus discussed in this application or in combination or in lieu of any method or method step discussed in this application to produce a desired end product.

Figure 8:
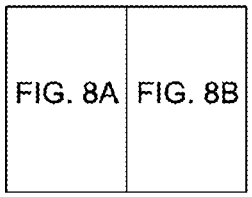
FIG. 8 is schematic view of a drug compounding skid according to an embodiment of the present invention, divided into parts FIG. 8A and FIG. 8B.
Figure 8A:
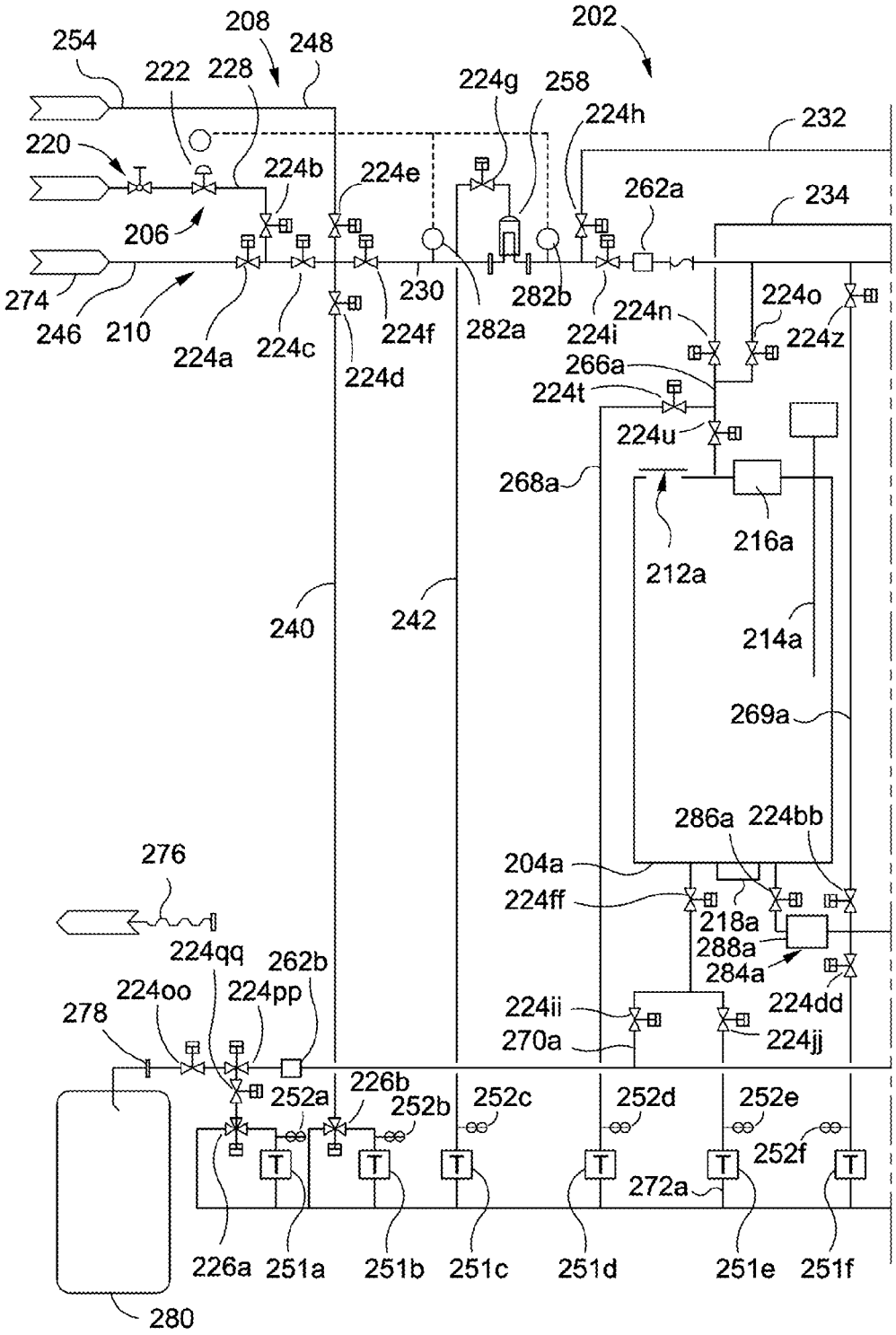
Figure 8B:
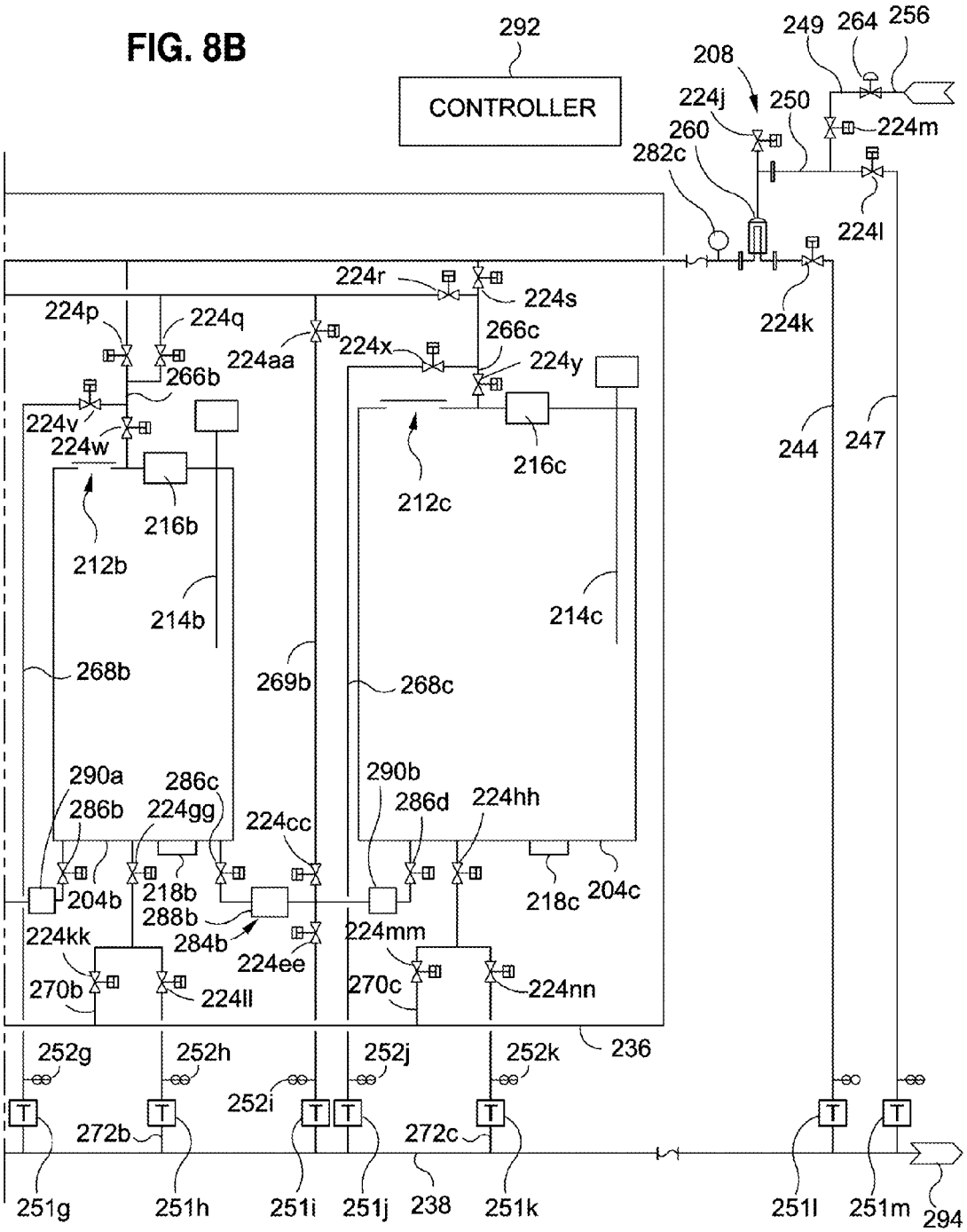

FIG. 8 illustrates a schematic view of an embodiment of a skid apparatus 202 for use to compound drugs. In this embodiment, the skid apparatus 202 includes a plurality of drug compounding tanks 204*a*, 204*b*, 204*c* each configured to retain a drug for compounding therein.

The tanks 204 each include an agitation device 214*a*, 214*b*, 214*c* that is top mounted to the respective tank 204*a*, 204*b*, 204*c*. The agitation devices 214 are configured to agitate a drug retained within the respective tank 204 when the drug retained within the respective tank 204 is being compounded. The agitation devices 214 may include an inline homogenizer, a static mixer, a triblender, and/or a disperser, or any other kind of agitation device as desired.

Each tank 204 may include a respective opening 212*a*, 212*b*, 212*c* that allows a drug or other desired material to be passed into the respective tank 204*a*, 204*b*, 204*c*. Upon delivery of a drug into the respective tank 204*a*, 204*b*, 204*c*, the agitation device 214 serves to agitate the drug in a compounding process. Each tank 204*a*, 204*b*, 204*c* may additionally include a port 216*a*, 216*b*, 216*c* that may receive an additional agitation device for use to agitate the drug contained within the tank 204*a*, 204*b*, 204*c*. The additional agitation device may be used in combination or in lieu of the agitation device 214*a*, 214*b*, 214*c* shown in FIG. 8 as being top mounted upon the respective drug compounding tank 204*a*, 204*b*, 204*c*.

Each tank 204*a*, 204*b*, 204*c* may have a different drug retention capacity than the other tanks. For example, tank 204*a* may have a smaller drug retention capacity than tank 204*b*, which has a smaller drug retention capacity than tank 204*c*. In one embodiment, each tank 204*a*, 204*b*, 204*c* may have a respective volume of 300 liters, 800 liters, and 1200 liters. In other embodiments, the respective volumes may be varied as desired.

Each tank 204 may be loaded on a respective load cell 218*a*, 218*b*, 218*c* that may be capable of sensing the weight of the respective tank 204*a*, 204*b*, 204*c* to determine how much drug or other desired material is contained within the tank 204.

The skid 202, similar to the skid 10 shown in FIG. 1 also includes a sterilization system 206, and a drug transfer system 208. The skid 202 may also include a cleaning system 210 to allow the skid 202 to be cleaned in place.

The sterilization system 206, similar to the sterilization system 14 shown in FIG. 1, includes a sterilizing steam input 220, valves 222, 224, 226, and conduits 228, 230, 232, 234, 236, 238, 240, 242, 244, 246, 247, 248, 249, 250, 266, 268, 269, 270, 272. The sterilization system may also include steam traps 251, thermal sensors 252 and pressure sensors 282.

Like components of the sterilization system 206 operate similarly as the components of the sterilization system 14 shown in FIG. 1. For example, the steam input 220 is configured to receive sterilizing steam from an outside source, for example, from a steam generator device. The steam input 220 may include a ball valve that is capable of being opened and closed to selectively allow steam to enter the conduit 228 from the outside source. A steam control valve 222 may also be used to control the rate at which steam enters the conduit 228.

The conduits 228, 230, 232, 234, 236, 238, 240, 242, 244, 246, 247, 248, 249, 250, 266, 268, 269, 270, 272 may comprise pipes. The pipes may have sufficient strength to withstand the pressure of sterilizing steam being passed therethrough. The pipes may be constructed in a manner that they may be sterilized.

The valves 222, 224, 226 are configured to open or close to block the passage of steam or to allow steam to pass therethrough. In one embodiment, the valve 222 may comprise a sanitary control valve. The valves 224 may comprise a two-way directional valve. The valves 226 may comprise a three-way directional valve. In one embodiment, the valves 224, 226 may each comprise a diaphragm valve. In one embodiment, the valves 224, 226 may each comprise a pneumatically actuated valve. In one embodiment, the valves 224, 226 may each comprise an electronically activated valve. In one embodiment, the valves 224, 226 may each comprise any combination of a diaphragm, pneumatically actuated, or electronically activated valve, as desired.

The thermal sensors 252 of the sterilization system 206 may be capable of detecting a temperature of the sterilizing steam used in the sterilization system 206. The thermal sensors 252 may be used to indicate when the temperature of the steam is too high or too low to effectively sterilize components of the skid 202, and may provide an indication to either increase a temperature of the steam input into the steam input 220, or to change a rate at which steam enters the steam input 220 or passes through the steam control valve 222.

The pressure sensors 282 of the sterilization system 206 may be capable of detecting a pressure of the sterilizing steam used in the sterilization system 206. The pressure sensors 282 may be used to indicate when a pressure of the steam is too high or too low to effectively sterilize components of the skid 202, and may provide an indication to either increase a pressure of the steam input into the steam input 220, or to change a rate at which steam enters the steam input 220 or passes through the steam control valve 222.

The sterilization system 206 is configured to pipe sterilizing steam throughout the conduits 228, 230, 232, 234, 236, 238, 240, 242, 244, 246, 247, 248, 249, 250, 266, 268, 269, 270, 272 and through the valves 222, 224, 226 to sterilize the conduits 228, 230, 232, 234, 236, 238, 240, 242, 244, 246, 247, 248, 249, 250, 266, 268, 269, 270, 272 and valves 222, 224, 226, and any other desired feature of the skid 202.

The sterilization system 206 may also be configured to sterilize an interior chamber of each the drug compounding tanks 204*a*, 204*b*, 204*c*. The sterilizing steam passes through valves 224*u*, 224*w*, 224.*y* and enters the interior chamber of the respective tanks 204*a*, 204*b*, 204*c*. The sterilizing steam then passes through valves 224*ff*, 224*gg*, 224*hh* to exit from the interior chamber.

Upon sterilizing steam passing through the conduits 228, 230, 232, 234, 236, 240, 242, 244, 246, 247, 248, 249, 250, 266, 268, 269, 270, 272 and through valves 222, 224, 226 of the skid, the steam may reach the steam traps 251. The steam traps 251 lock the sterilizing steam within the conduits 228, 230, 232, 234, 236, 240, 242, 244, 246, 247, 248, 249, 250, 266, 268, 269, 270, 272 of the skid 202. Condensation produced from the sterilizing steam is collected within the steam traps 251 and is passed to the conduit 238. The conduit 238 conveys the condensation to a drain 294 for removal from the sterilization system 206.

The drug transfer system 208 also operates similarly as the drug transfer system 16 shown in FIG. 1. The drug transfer system 208 includes a fluid inlet, or fluid inlets, which may include a water inlet 254, and an air inlet 256. The drug transfer system 208 also includes conduits 248, 230, 234, 266, 270, 236, 249, 250 and valves 224*c*, 224*d*, 224*e*, 224*f*, 224*g*, 224*h*, 224*i*, 224*j*, 224*k*, 224*l*, 224*m*, 224*n*, 224*o*, 224*p*, 224*q*, 224*r*, 224*s*, 224*u*, 224*w*, 224*y*, 224*ff*, 224*gg*, 224*hh*, 224*ii*, 224*jj*, 224*kk*, 224*ll*, 224*mm*, 224*nn*, 224*pp*, 224*qq*, 224*oo* and may include filters 258, 260, flow meters 262, a regulator 264, and pressure sensors 282.

The fluid inlets are configured to allow a fluid such as air or water to enter the inlet from an outside source. For example, the water inlet 254 is configured to receive water, preferably purified water, from an outside water source. The water inlet 254 allows the water to enter the conduit 248. The air inlet 256 is configured to receive air, preferably oil free air, from an outside air source. The outside air source preferably provides pressurized air, and may comprise an air compressor. The air inlet 256 allows the air to enter the conduit 249.

The water inlet 254 and air inlet 256 may operate in combination to transfer compounded drugs from the compounding tank 204*a*, 204*b*, 204*c* to the holding tank 280. The water inlet 254 may allow water to pass through the conduit 248, through the valves 224*e*, 224*f*, and through liquid filter 258. The water then passes through valve 224*i* and valves 224*o*, 224*q*, 224*r* to pass into conduit 266. Water may then pass through valves 224*u*, 224*w*, 224.*y* to then flush out the drug compounded within the interior chamber. The water may flush out the drug to conduit 236, which passes through valves 224*pp*, 224*oo* to holding tank 280.

The air inlet 256 is used to drive the fluid through the drug compounding tanks 204 to allow it to enter the holding tank 280. The air inlet 256 may allow air to pass through the conduit 249 and through the valve 224*m* so that is passes through conduit 234, and passes through valves 224*n*, 224*p*, 224*s*. The air drives the water through the conduit 266*a*, 266*b*, 266*c* and conveys it through the respective valves 224*u*, 224*w*, 224*y*, through the interior chamber of the respective holding tanks 204. The air conveys the water, and the drug through the valves 224*ff*, 224*gg*, 224*hh* and 224*ii*, 224*kk*, 224*mm* and then through the conduit 236, through the valves 224*pp*, 224*oo* and to the holding tank 280. The air passes through a filter 260 that scrubs particulate matter and microbes from the air. The regulator 264 may be used to control the air pressure passing through the conduits 249, 250, 234, 266, 270, 236. The pressure sensors 282 may be used to provide a measure of the fluid pressure passing through the conduits, to determine if the pressure should be lowered or raised as desired.

The cleaning system 210 includes a cleaning fluid inlet 274 that allows a cleaning fluid to enter the conduit 246. The cleaning fluid may comprise water, air, or a caustic fluid such as acid or the like. The cleaning fluid may be provided by a remote cleaning device, such as a cleaning skid. The cleaning fluid may pass through any of the valves 222, 224, 226 and conduits 228, 230, 232, 234, 236, 238, 240, 242, 244, 246, 247, 248, 249, 250, 266, 268, 269, 270, 272. The cleaning fluid may also pass through the steam traps 251, filters 258, 260, and flow meters 262. A cleaning system return 276 may be coupled to a coupler 278 that is used to couple the holding tank 280 to the conduit 236. The cleaning system return 276 retrieves the cleaning fluid from the skid device 202 after the cleaning fluid has passed through the desired components of the skid device 202.

The skid 202 may additionally include a tank-to-tank drug transfer system 284*a*, 284*b* that allows drugs, compounded drugs, or other desired material to be passed between the tanks 204*a*, 204*b*, 204*c*. The drug transfer system 284*a*, 284*b* includes valves 286*a*, 286*b*, 286*c*, 286*d*, pumps 288*a*, 288*b*, and filters 290*a*, 290*b*. The valves 286 may be used to seal off transfer of the desired material between the tanks 204*a*, 204*b*, 204*c*. Upon the valves 286 being opened, the pumps 288 are configured to pump the desired material from tank to tank. The filters 290 are configured to filter the desired material that is passed from tank to tank. A conduit extends from tank to tank to allow the desired material to be passed from tank to tank.

Separate conduits 269*a*, 269*b* may be utilized as part of the sterilization system 206, to allow sterilizing steam to pass to and sterilize the tank-to-tank drug transfer system 284*a*, 284*b*. The sterilization system may include valves 286 which are opened or closed to allow sterilizing steam to pass therethrough.

In one embodiment, a controller device 292 may be configured to control inlets 254, 220, 274, 256 and/or valves 222, 224, 226, 286 and/or regulator 264. In addition, the controller device 292 may be configured to receive a temperature reading from temperature sensors 252 and/or a pressure reading from pressure sensors 282. The controller device 292 may also be configured to receive a rate of flow reading from flow sensors 262. The controller device 292 may be configured to electrically and automatically open or close one or more of inlets 254, 220, 274, 256 and/or valves 222, 224, 226, 286 and/or regulator 264 to operate any of the sterilization system 206, the drug transfer system 208, the cleaning system 210, or the tank-to-tank drug transfer system 284. The controller device 292 may comprise an electrical controller device including a processor and memory, and capable of being programmed for operation. In one embodiment, the controller device 292 may comprise a dedicated controller designed to only perform certain tasks related to the sterilization system 206, the drug transfer system 208, the cleaning system 210, or the tank-to-tank drug transfer system 284. The controller device 292 may be electrically wired to any component of the skid device 202 to provide for desired operation.

In a mode of operation in which the controller device 292 operates the sterilization system 206, the controller device 292 may open any of the valves 222, 224, 226, 286 to allow sterilizing steam to sterilize any desired component of the skid device 202. The controller device 292 may receive a temperature reading from one of the temperature sensors 252 to determine if the temperature of the sterilizing steam is too high or too low, and may open or close one or more valves 222, 224, 226, 286 to allow the temperature to reach a desired point. The controller device may also receive a pressure reading from one of the pressure sensors 282 to determine if the pressure of the sterilizing steam is too high or too low, and may open or close one or more valves 222, 224, 226, 286 to allow the pressure to reach a desired point. In addition, the controller device 292 may operate to vary the temperature or pressure of the sterilizing steam by controlling the remote steam generation device. In one embodiment, the controller device 292 may send a signal for a user to vary the temperature or pressure of the sterilizing steam by controlling the remote steam generation device. In one embodiment, the controller device 292 may send a signal for a user to vary the temperature or pressure of the sterilizing steam by controlling the amount of steam passing through the steam inlet 220 and the steam control valve 222. The signal may comprise an alarm or the like.

In a mode of operation in which the controller device 292 operates the drug transfer system 208, the controller device 292 may open any of the valves 224 and operate regulator 264 to allow fluid to convey a compounded drug contained within the tank 204 to the holding tank 280. The controller device 292 may receive a flow reading from one of the flow sensors 262 to determine if the rate of flow of the fluid, including water and/or air is too high or too low, and may open or close one or more valves 224 or regulator 264 to allow the flow rate to reach a desired point. The controller device may also receive a pressure reading from one of the pressure sensors 282 to determine if the pressure of the fluid is too high or too low, and may open or close one or more valves 224 or regulator 264 to allow the fluid pressure to reach a desired point. In addition, the controller device 292 may operate to vary the flow rate and/or pressure of the fluid by controlling the remote water supply device and/or the air pressure device. In one embodiment, the controller device 292 may send a signal for a user to vary the flow and/or pressure of the fluid by controlling the water supply device and/or the air pressure device. In one embodiment, the controller device 292 may send a signal for a user to vary the flow rate and/or pressure of the air by controlling the amount of air passing through the air inlet 256 and the regulator 264. The signal may comprise an alarm or the like.

In a mode of operation in which the controller device 292 operates the cleaning system 210, the controller device 292 may open any of the valves 222, 224, 226 to allow a cleaning fluid to clean any desired component of the skid device 202. The controller device 292 may receive a flow reading from one of the flow sensors 262 to determine if the rate of flow of the cleaning fluid, and may open or close one or more valves 222, 224, 226 to allow the flow rate to reach a desired point. In addition, the controller device 292 may operate to vary the flow rate of the cleaning fluid by controlling the remote cleaning device. In one embodiment, the controller device 292 may send a signal for a user to vary the flow of the cleaning fluid by controlling the remote cleaning device. The signal may comprise an alarm or the like.

Figure 9A:
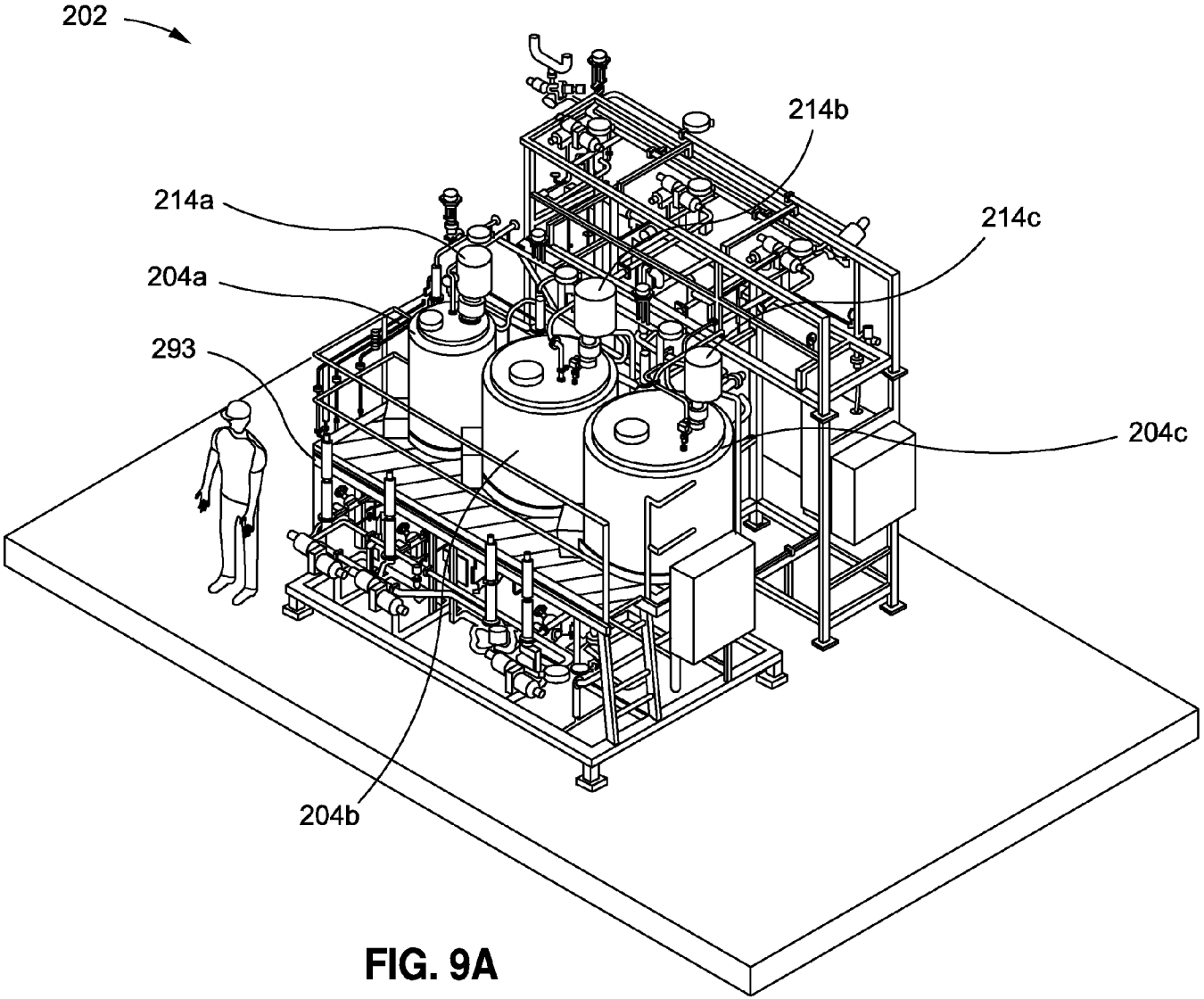
FIG. 9A is a front perspective view of a drug compounding skid according to an embodiment of the present invention.

FIG. 9A illustrates a front perspective view of the skid apparatus 202 for use to compound drugs. Components of the skid apparatus 202, including the drug compounding tanks 204, are shown to be coupled to a frame 293 that stands upon a supporting surface. The frame 293, similar to the frame 160 shown in FIGS. 6A-6G includes a plurality of horizontal and vertical support bars.

Figure 9B:
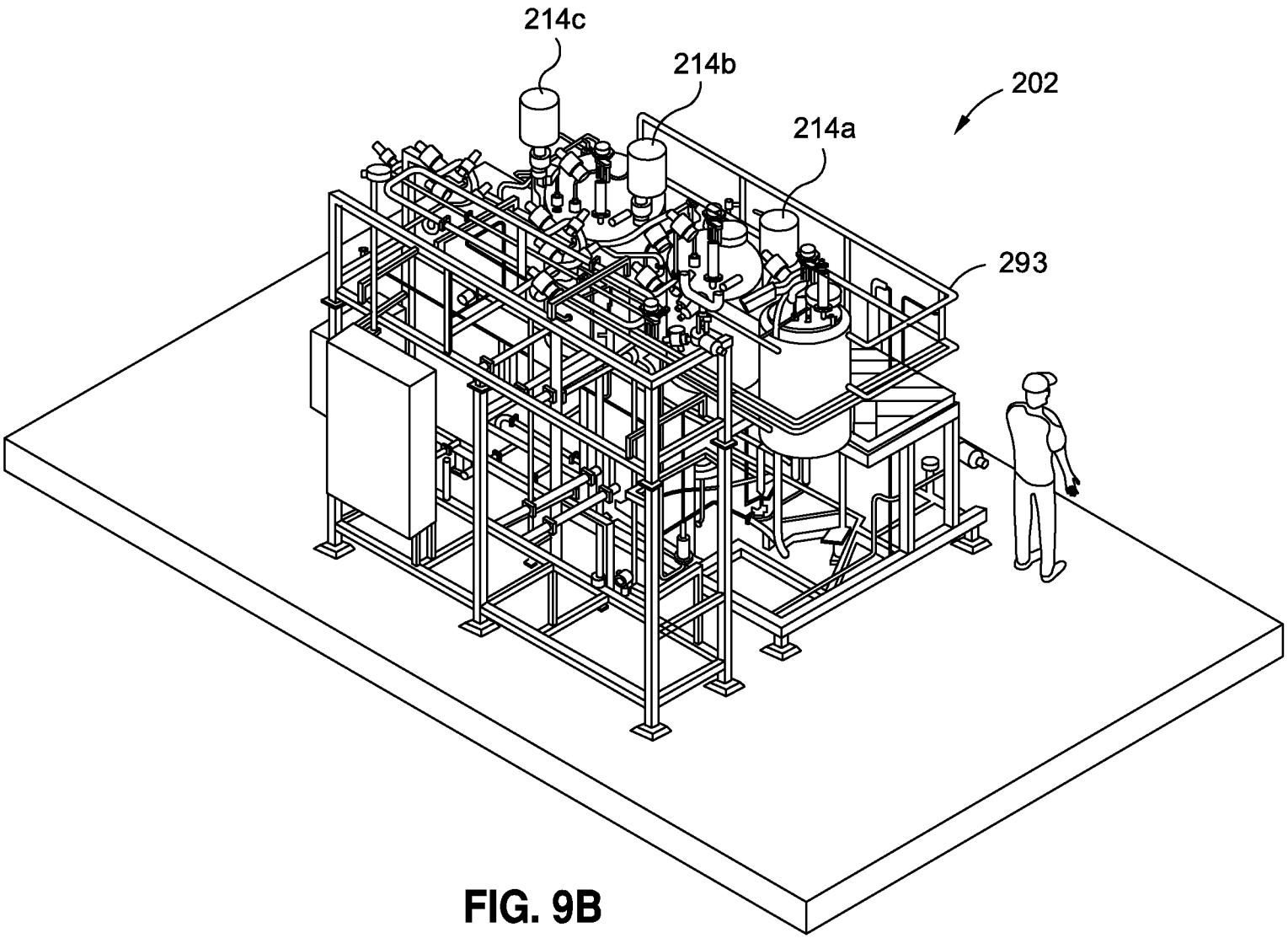
FIG. 9B is a rear perspective view of the drug compounding skid shown in FIG. 9A according to an embodiment of the present invention

FIG. 9B illustrates a rear perspective view of the skid apparatus 202 for use to compound drugs.

The skid apparatus 202 beneficially allows drugs to be compounded in any or all of the drug compounding tanks 204. In an embodiment in which the tank-to-tank drug transfer system 284 is utilized, a first component of a desired drug may be formulated in a first tank, and a second component of a desired drug may be formulated in a second tank. At a desired time, the first component of the desired drug may then be transferred from the first tank to the second tank, and the components may be mixed as desired. The components may be mixed before they are ultimately transferred to the holding tank 280 illustrated schematically in FIG. 8.

In one embodiment, the controller device 292 may be used to electronically detect connection of an agitation device to a port 216 of the drug compounding tank. The controller device 292 may be able to determine a mode of operation based on the detected agitation device and may be able to operate the agitation device accordingly.

In one embodiment, the controller device 292 may be programmed with a sequence of operation for each agitation device 214 that is connected to the respective drug compounding tank 204*a*, 204*b*, 204*c*. The controller device 292 may operate each agitation device 214 according to the sequence programmed into the controller device 292. In one embodiment, the controller device 292 may be configured to operate the tank-to-tank drug transfer systems 284 to automatically control transfer of a drug or other desired material from one tank to another tank. The controller device 292 may be configured to automatically control valves 286*a*, 286*b*, 286*c*, 286*d*, and pumps 288*a*, 288*b* to effect transport of a drug or other desired material from tank to tank. The controller device 292 may be capable of automatically operating the agitation device 214 associated with each tank 204, then passing the drug or other desired material from one tank to another tank, and then passing the material to the holding tank 280 for collection.

The skid 202 beneficially allows for drug compounding and transfer of drugs or materials from tank to tank to expedite the drug compounding process. In an embodiment in which the operation of the skid 202 is automated, the skid 202 may serve as an efficient automated system to pass drugs from one tank to another and to be ultimately collected.

Figures 10, 10A:
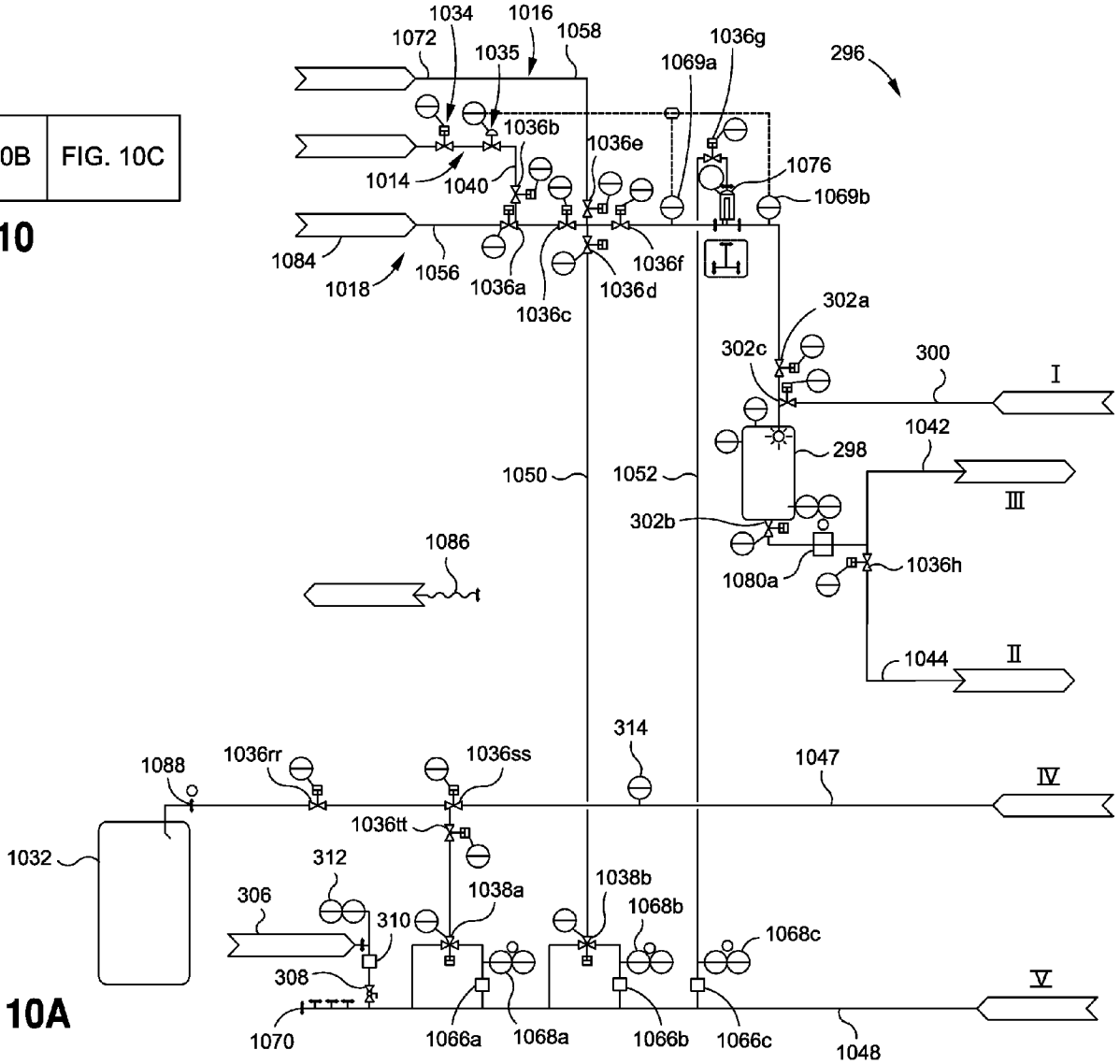
FIG. 10 is schematic view of a drug compounding skid according to an embodiment of the present invention, divided into parts FIG. 10A, FIG. 10B and FIG. 10C.
Figure 10B:
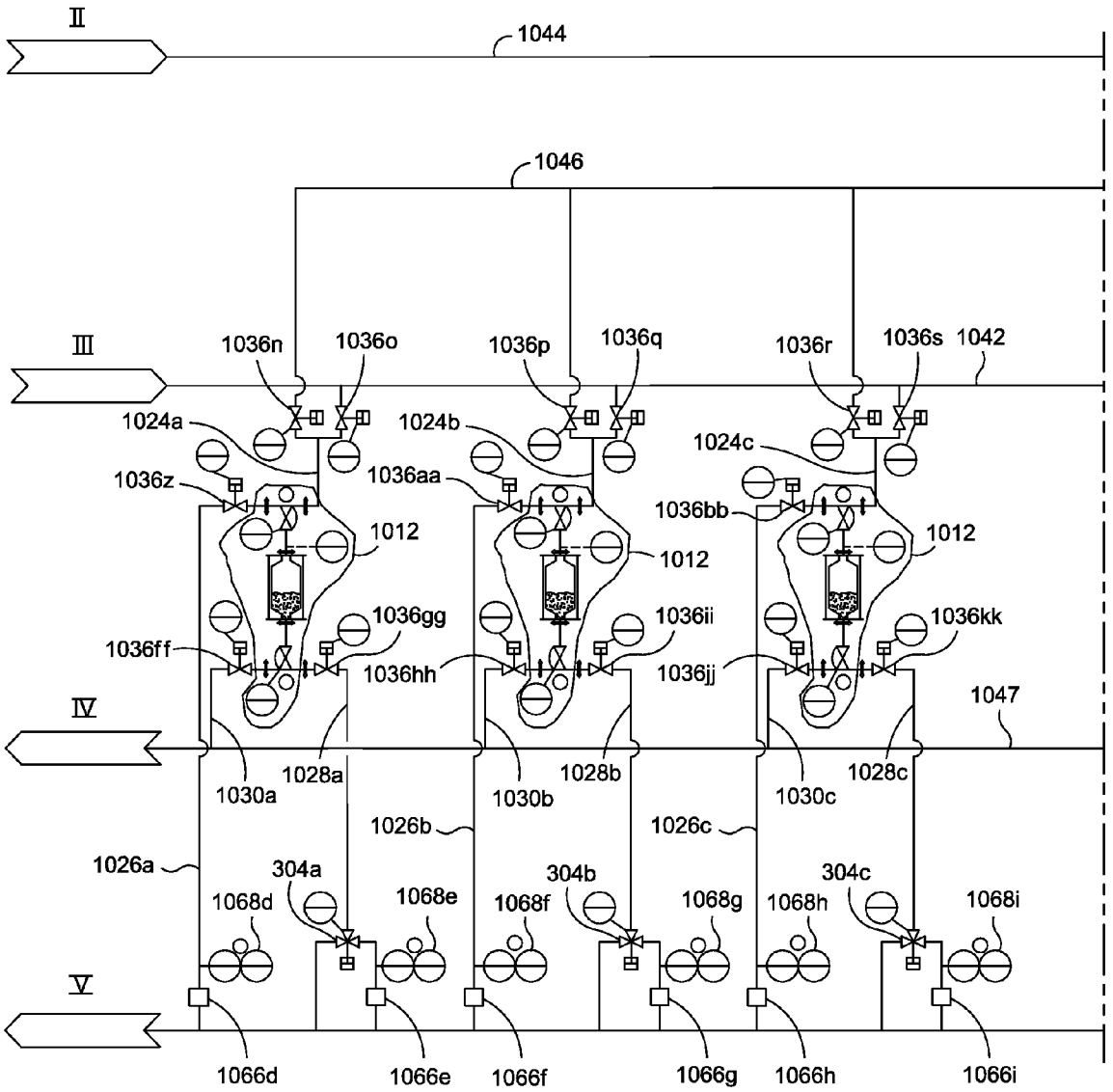
Figure 10C:
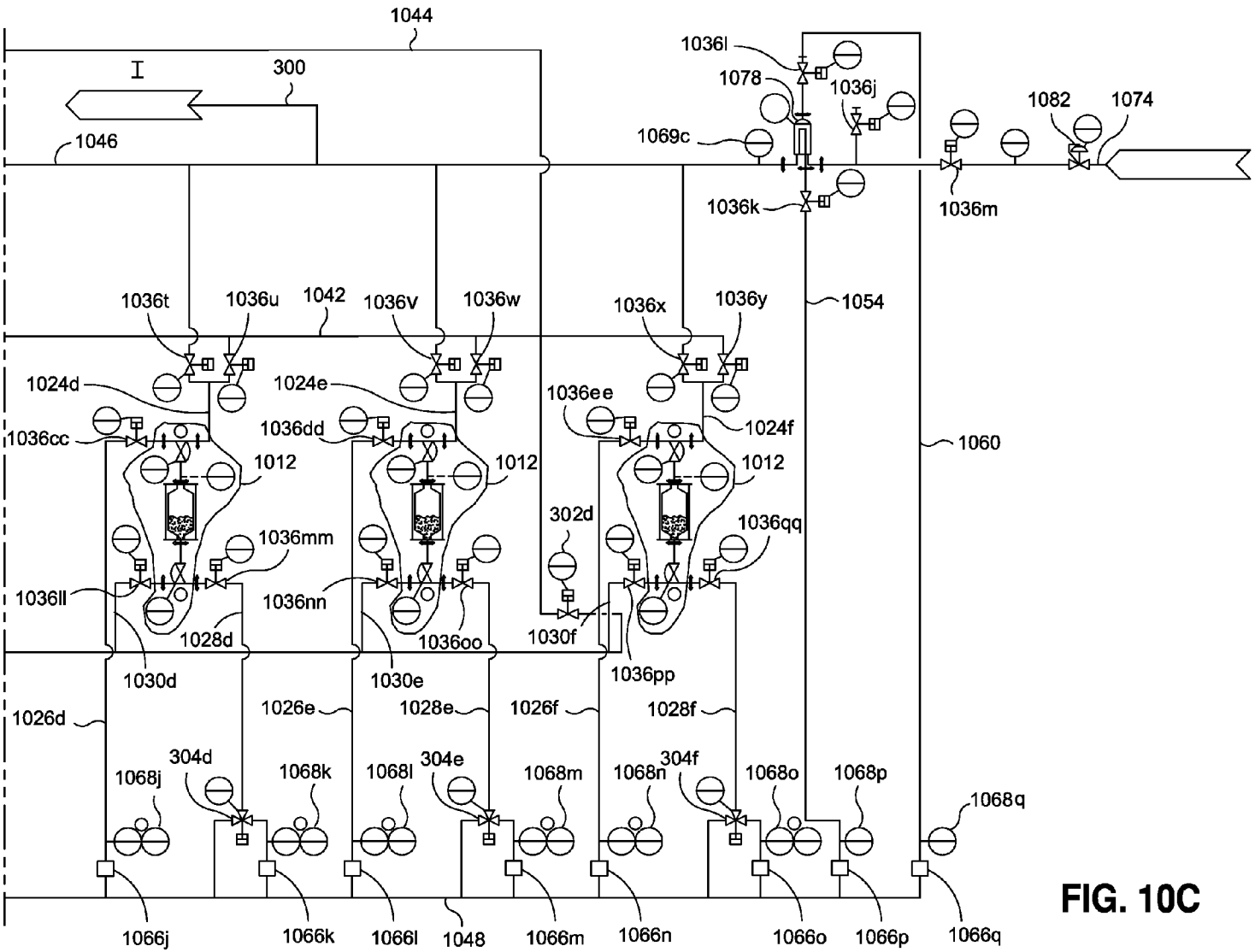

FIG. 10 illustrates a schematic view of a skid 296 for sterile transfer of a compounded drug. The skid 296 operates in a similar manner as the skid 10 shown in FIG. 1, unless otherwise indicated. Like elements of the skid 296 are marked with a prefix of "10" in relation to the elements of skid 10. Identical roman numerals across FIGS. 10A and 10B are meant to indicate connections between the conduits across these portions of the schematic.

The sterilization system 1014 operates in a similar manner as described in regard to the sterilization system 14 of FIG. 1. The sterilization system 1014 serves to sterilize any desired component of the skid 296. The drug transfer system 1016 operates in a similar manner as described in regard to the drug transfer system 16 of FIG. 1. The drug transfer system 1016 serves to transfer a drug compounded within the vessels 1012 to a holding tank 1032. The cleaning system 1018 serves to clean any desired component of the skid 296, with the vessels 1012 preferably removed from the remaining portions of the skid 296 during cleaning.

A difference between the skid 296 shown in FIG. 10 and the skid 10 shown in FIG. 1 is the skid 296 is configured to use a fluid tank 298 that is used as a component of the drug transfer system 1016. The fluid tank 298 holds water for use to flush through the vessels 1012 to transport the compounded drug from the vessels 1012 to the holding tank 1032. The fluid tank 298 may be filled from the water inlet 1072 that passes through valves 1036*e*, 1036*f* and through valve 302*a*. The valve 302*b* may be closed during the filling operation. Air from air inlet 1074 may pass through conduit 1046 and conduit 300 to reach valve 302*c*. Upon the valve 302*c* being opened, the air may pressurize the water in the fluid tank 298. The valve 302*b* may be opened to cause the pressurized water to pass through conduit 1042 and conduit 1024 and flush drug compounded within the vessel 1012 through conduit 1030 and conduit 1047 to holding tank 1032.

The valve 1036*h* may additionally be opened to allow pressurized fluid from the fluid tank 298 to pass through conduit 1044. Upon the valve 302*d* being opened, the fluid passes through the conduit 1047 to flush drug from the vessel 1012 down the conduit 1047. In one embodiment, the valve 1036*ss* is closed during this operation, causing the pressurized fluid to pass through conduit 1030 and valves 1036*ff*, 1036*hh*, 1036*jj*, 1036*ll*, 1036*nn*, 1036*pp*. The pressurized fluid may enter the vessel 1012 from its lower, or second end, and flush compounded drug away from the grinding beads contained within the vessel 1012, by fluid passing upward into the vessel and contacting the grinding beads. The valve 1036*ss* may then be opened to cause the fluid within the vessel 1012 to drop downwards and drain from the vessel 1012. In one embodiment, pressurized fluid passing through conduit 1042 and 1024 may enter the vessel 1012 from its upper, or first end at the same time fluid enters the vessel 1012 from below. Any combination of pressurized fluid entering the vessel 1012 from its lower end or upper end may be used to transfer drug from the vessel 1012 to the holding tank 1032.

The skid 296 may additionally include valves 304 which allow sterilizing steam or other fluid to pass to and from conduit 1028 without passing through steam traps 1066*e*, 1066*g*, 1066*i*, 1066*k*, 1066*m*, 1066*o*. The valves 304 may comprise a three way directional valve, and may comprise a diaphragm, pneumatically actuated, or electronically activated valve, or any combination therein as desired.

The skid 296 may include a holding tank coupler 306 that allows fluid, including sterilizing steam to pass from the holding tank 1032 and to the drain 1070. A valve 308 may control flow of the fluid from the holding tank 1032 to the conduit 1048. A steam trap 310 may prevent sterilizing steam from passing from the holding tank 1032 to the drain 1070. A thermal sensor 312 may detect a temperature of fluid passing from the holding tank 1032.

The conduit 1047 may additionally include a pressure sensor 314 to detect a pressure of a fluid passing through conduit 1047.

The valves 302, 308 may comprise a two-way directional valve, and may comprise a diaphragm, pneumatically actuated, or electronically activated valve, or any combination therein as desired.

A controller, similar to the controller 90 shown in FIG. 1, may serve to operate any component of the sterilization system 1014, the drug transfer system 1016, and/or the cleaning system 1018 in a manner described in regard to FIG. 1.

Figure 11A:
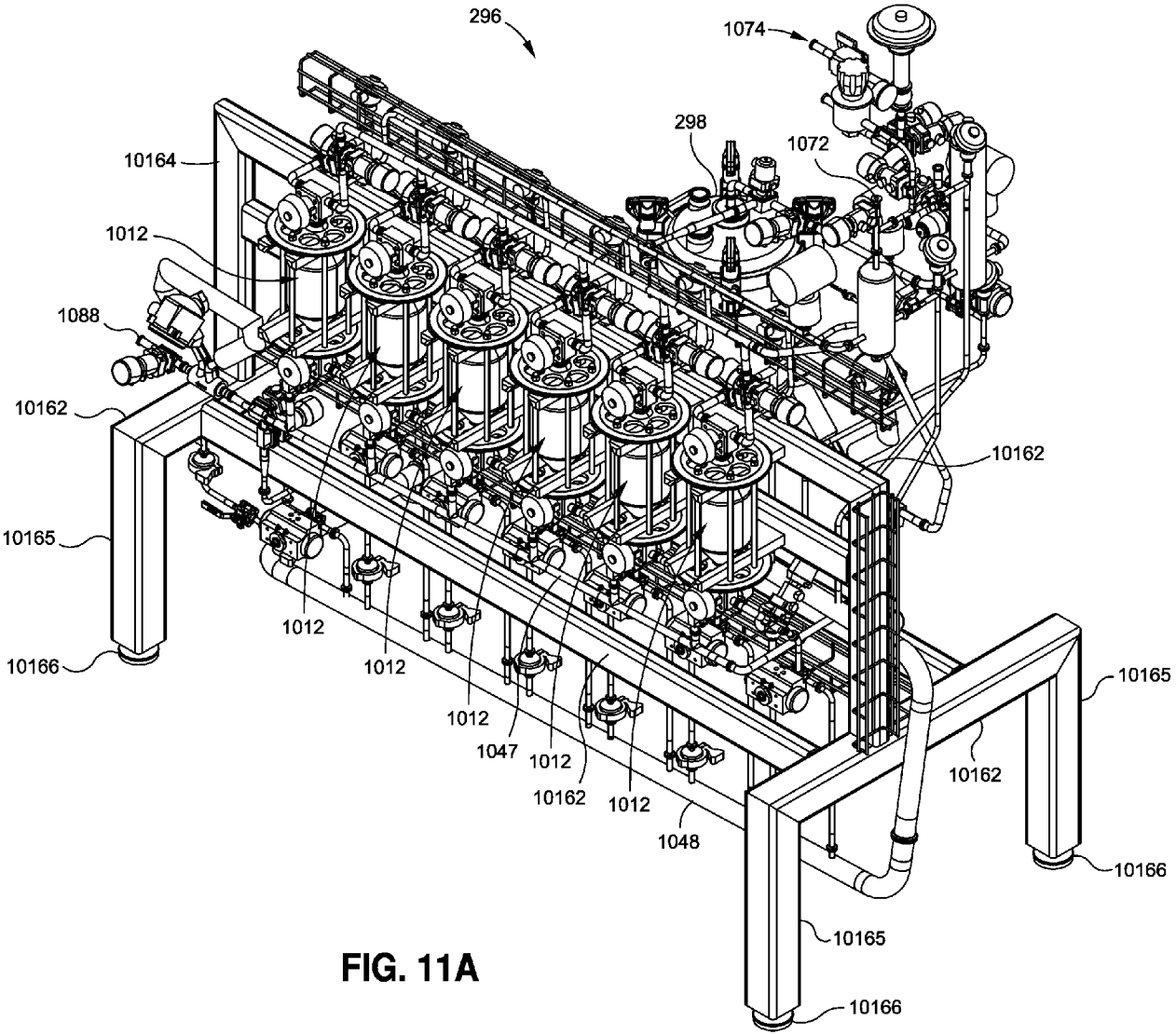
FIG. 11A is a front perspective view of a drug compounding skid according to an embodiment of the present invention.

FIGS. 11A-11E illustrate views of the skid 296 shown schematically in FIG. 10. Like elements of the skid 296 are marked with a prefix of "10" in relation to the elements of skid 10 shown in FIGS. 6A-6G. FIG. 11A illustrates a front perspective view of the skid frame showing the horizontally extending bars 10162 joined to the plurality of vertically extending bars 10164. The legs 10165 extend from the horizontally extending bars 10162. Feet 10166 are positioned at the lower end of frame legs 10165.

Figure 11B:
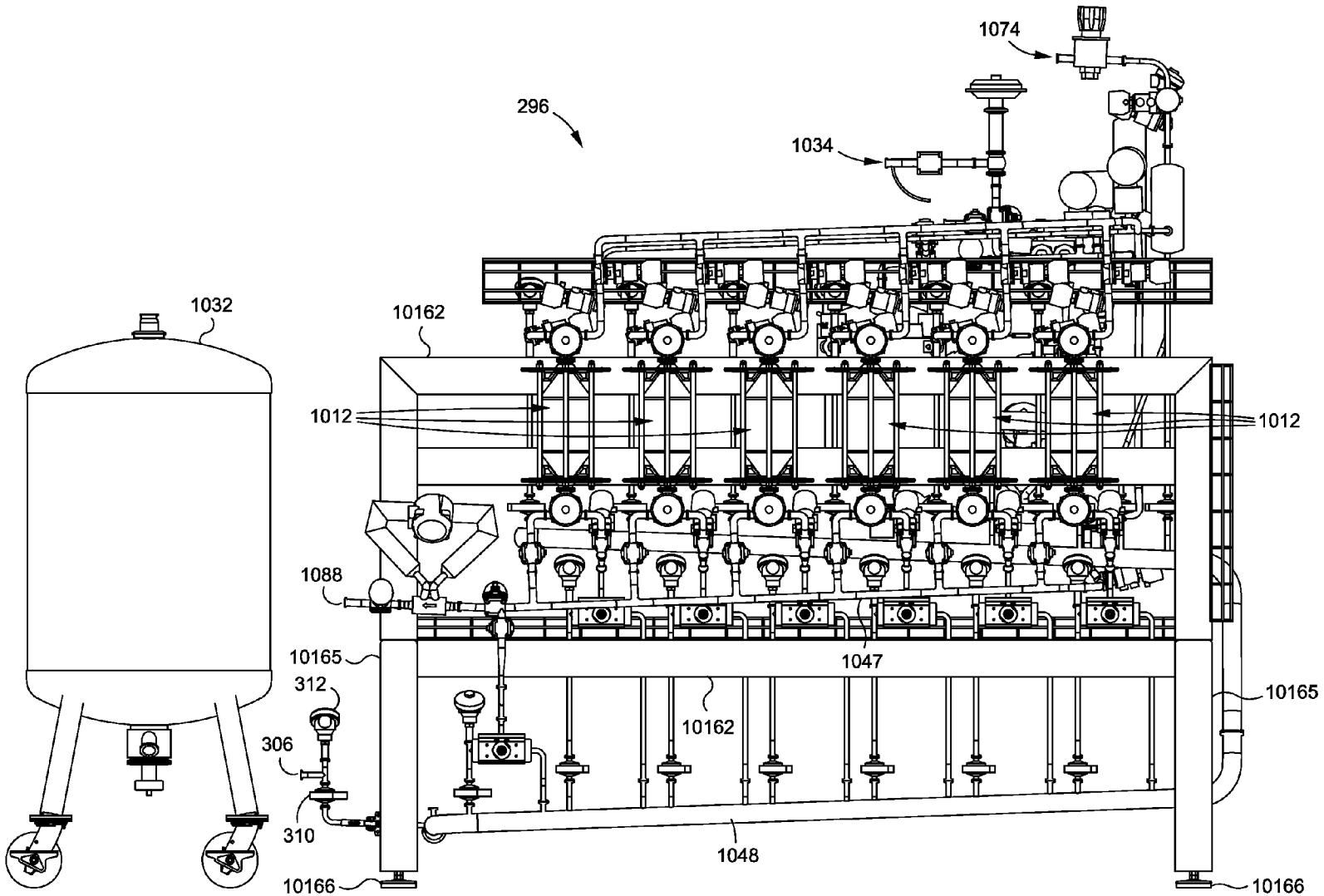
FIG. 11B is a front view of the drug compounding skid shown in FIG. 11A according to an embodiment of the present invention.
Figure 11C:
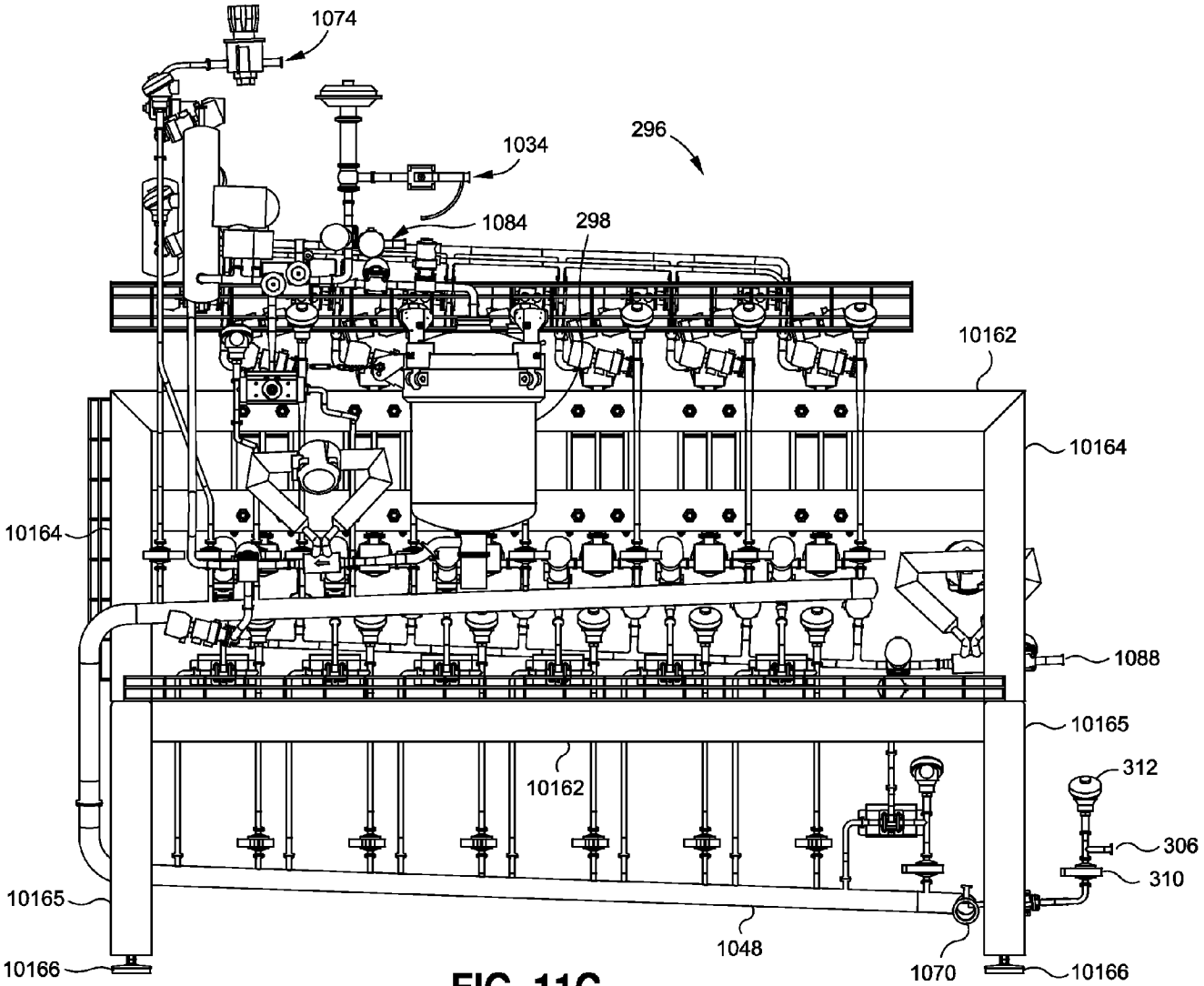
FIG. 11C is a rear view of the drug compounding skid shown in FIG. 11A according to an embodiment of the present invention.

FIG. 11B illustrates a front view of the skid 296. The holding tank 1032 is visible positioned adjacent to the coupler 1088 and the holding tank coupler 306. The holding tank 1032 is configured to be separable from the skid 296. In the embodiment shown in FIG. 11B, wheels are shown at the bottom of holding tank 1032 to allow it to be portable relative to the skid 296. FIG. 11C illustrates a rear view of the skid 296. The drain 1070 is visible extending away from the holding tank coupler 306. The fluid tank 298 is visible positioned at the rear of the skid frame.

Figure 11D:
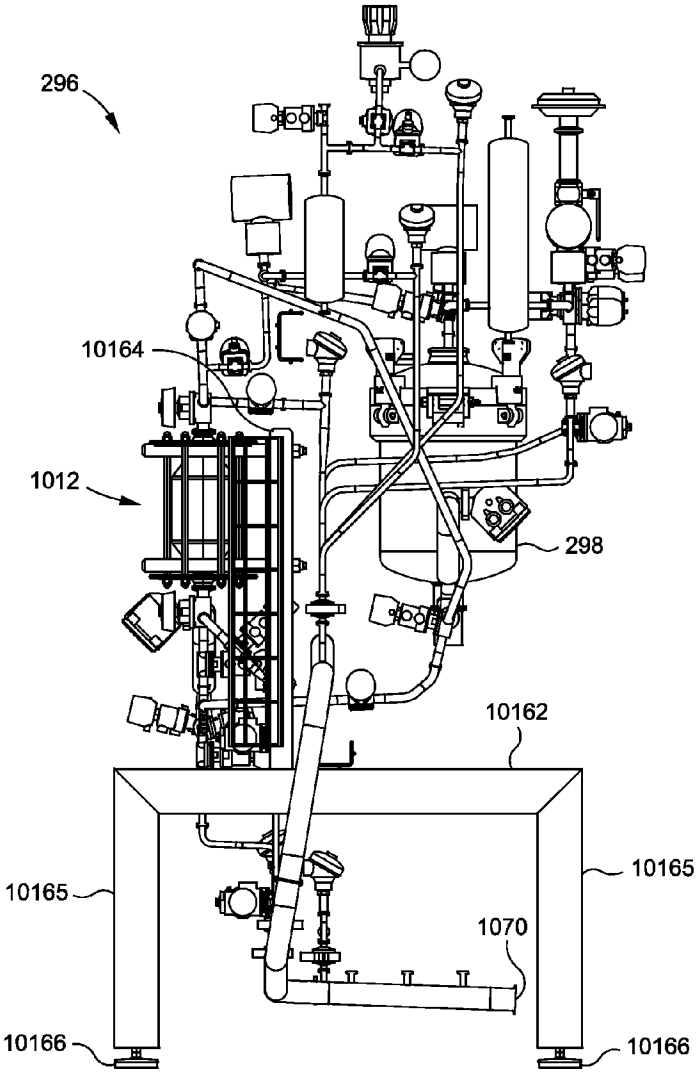
FIG. 11D is a right side view of the drug compounding skid shown in FIG. 11A according to an embodiment of the present invention.
Figure 11E:
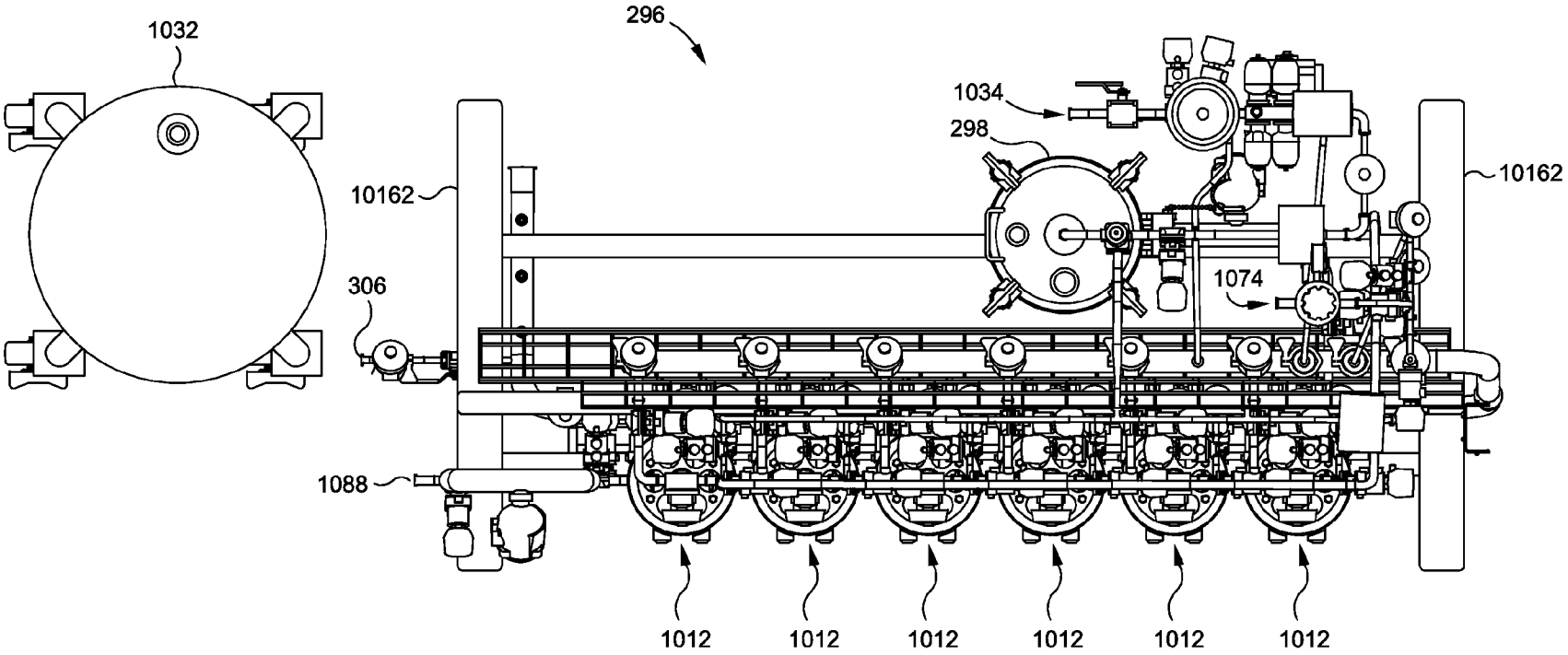
FIG. 11E is a top view of the drug compounding skid shown in FIG. 11A according to an embodiment of the present invention.

FIG. 11D is a right side view of the skid 296. The position of the fluid tank 298 is visible relative to the vessels 1012. FIG. 11E is a top view of the skid 296.

The skid 296 embodiment shown in FIGS. 10-11 allows for use of the fluid tank 298, which beneficially improves control of the fluid used in the fluid transfer system 1014. The skid 296 embodiment additionally allows for use of the holding tank coupler 306, which may allow fluid, including sterilizing steam, to be drained from the holding tank 1032 if desired.

The skid devices disclosed throughout this application may be used to compound any form of drug desired. Certain exemplary drugs include steroids, antihistamines, sympathomimetics, beta receptor blockers, parasympathomimetics, parasympatholytics, prostaglandins, non-steroidal anti-inflammatory drugs, topical anesthetics, among others. Such drugs may include a cyclosporine ophthalmic emulsion, a brimonidine tartrate ophthalmic solution, a bimatoprost ophthalmic solution, a ketorolac tromethamine ophthalmic solution, a nedocromil sodium ophthalmic solution, onabotulinumtoxinA, an epinastine HCL ophthalmic solution, alcaftadine ophthalmic solution, a prednisolone acetate ophthalmic suspension, a gatifloxacin ophthalmic solution, and a gatifloxacin ophthalmic solution, among others. The compounded drugs may be offered by brand name, including those offered by Allergan®, Inc., under names such as Refresh®, Restasis®, Alphagan®, Combigan®, Lumigan®, Acular LS®, Acuvail®, Alocril®, Botox®, Elestat®, Lastacaft®, Ozurdex®, Pred Forte®, Zymar®, and Zymaxid®, among others. The description of drugs is intended to be exemplary and non-limiting in nature.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of the present invention, which is defined solely by the claims. Accordingly, the present invention is not limited to that precisely as shown and described.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. In addition, each length, width, height, or other dimension disclosed in this application may be varied as desired to produce an equivalent result. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the present invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

What is claimed is:

1. A skid apparatus for sterile transfer of a compounded drug comprising:

a frame configured to stand upon a supporting surface;

a vessel having an interior chamber and an outer surface with a first open end and a second open end, and configured to retain a drug that is compounded within the interior chamber, and having a first valve at the first open end and a second valve at the second open end that are configured to form a sterile seal of the drug compounded within the interior chamber, the vessel configured to be releasably retained by the frame and to be used with a drug compounding device that compounds the drug within the interior chamber when the vessel is released from the frame;

a sterilization system coupled to the frame and configured to direct sterilizing steam to contact and sterilize the first valve and the second valve when the vessel is retained by the frame; and a drug transfer system coupled to the frame and configured to direct fluid such that the fluid passes through the first valve, then through the interior chamber, and then through the second valve to transfer the drug that is compounded within the interior chamber to a holding tank when the vessel is retained by the frame.

2. The apparatus of claim 1, wherein the vessel includes a plurality of grinding beads in the interior chamber that are configured to grind the drug when it is being compounded.

3. The apparatus of claim 2, wherein the vessel includes a filter configured to prevent the grinding beads from exiting the vessel when the fluid passes through the first valve, then through the interior chamber, and then through the second valve.

4. The apparatus of claim 1, further comprising a controller device configured to automatically operate the sterilization system and the drug transfer system.

5. The apparatus of claim 4, wherein the controller device is configured to automatically open at least one valve to allow the sterilizing steam to contact and sterilize the first valve and the second valve.

6. The apparatus of claim 4, wherein the controller device is configured to automatically open at least one valve to allow the fluid to pass through the first valve, then through the interior chamber, and through the second valve.

7. The apparatus of claim 1, further comprising a cleaning system configured to deliver fluid through pipes of the sterilization system and the drug transfer system to clean the pipes.

8. The apparatus of claim 1, wherein the first valve is configured to form a sterile bond with a conduit of the sterilization system.

9. The apparatus of claim 8, wherein the first valve is configured to either be open or closed when the first valve forms the sterile bond with the conduit of the sterilization system.

10. The apparatus of claim 1, wherein the vessel is a first vessel; and the apparatus further comprises a second vessel having an interior chamber and an outer surface with a first open end and a second open end, and configured to retain a drug that is compounded within the interior chamber of the second vessel, and having a first valve at the first open end and a second valve at the second open end of the second vessel that are configured to form a sterile seal of the drug compounded within the interior chamber of the second vessel, the second vessel configured to be releasably retained by the frame and to be used with the drug compounding device that compounds the drug within the interior chamber of the second vessel when the second vessel is released from the frame.

11. The apparatus of claim 10, wherein the drug transfer system includes a pipe configured to allow the drug that is compounded within the interior chamber of the first vessel and the drug that is compounded within the interior chamber of the second vessel to transfer to the holding tank when the first vessel and the second vessel are both retained by the frame.

12. The apparatus of claim 1, wherein the frame is configured to releasably retain the vessel such that the first open end is substantially above the second open end when the vessel is retained by the frame.

* * * * *

UNITED STATES PATENT AND TRADEMARK OFFICE

CERTIFICATE OF CORRECTION

PATENT NO. : 9,314,404 B2
APPLICATION NO. : 13/848586
DATED : April 19, 2016
INVENTOR(S) : Jose Gonzalez-Miranda et al.

It is certified that error appears in the above-identified patent and that said Letters Patent is hereby corrected as shown below:

In the specification,

In column 3, line 43, delete "invention" and insert -- invention; --, therefor.

In column 8, line 25, delete "32" and insert -- 32. --, therefor.

In column 17, line 11, delete "224.y" and insert -- 224y --, therefor.

In column 17, line 53, delete "224.y" and insert -- 224y --, therefor.

Signed and Sealed this
Twelfth Day of July, 2016

Michelle K. Lee

Michelle K. Lee
*Director of the United States Patent and Trademark Office*